US009139017B2

(12) United States Patent
Endo

(10) Patent No.: US 9,139,017 B2
(45) Date of Patent: Sep. 22, 2015

(54) PRINTING DEVICE, PRINTHEAD, AND METHOD OF POSITIONING PRINT MEDIA IN A PRINTER

(71) Applicant: SEIKO EPSON CORPORATION, Tokyo (JP)

(72) Inventor: Katsuyuki Endo, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/323,139

(22) Filed: Jul. 3, 2014

(65) Prior Publication Data

US 2015/0009257 A1 Jan. 8, 2015

(30) Foreign Application Priority Data

Jul. 4, 2013 (JP) ..... 2013-140362
Aug. 30, 2013 (JP) ..... 2013-180017

(51) Int. Cl.

| | |
|---|---|
| ***B41J 13/00*** | (2006.01) |
| ***B41J 2/32*** | (2006.01) |
| ***B41J 11/42*** | (2006.01) |
| ***B41J 11/46*** | (2006.01) |

(52) U.S. Cl.

CPC .. *B41J 2/32* (2013.01); *B41J 11/42* (2013.01); *B41J 11/46* (2013.01)

(58) Field of Classification Search

CPC ..... B41J 11/008; B41J 13/0009
USPC ..... 347/16, 37, 101, 104–105
See application file for complete search history.

(56) References Cited

U.S. PATENT DOCUMENTS

| | | | | |
|---|---|---|---|---|
| 6,511,141 | B1 * | 1/2003 | Hasegawa et al. | 347/3 |
| 2012/0044313 | A1 | 2/2012 | Yamada | |
| 2013/0020758 | A1 | 1/2013 | Momose et al. | |
| 2013/0229480 | A1 | 9/2013 | Yamada | |
| 2014/0098173 | A1 | 4/2014 | Yamada | |

FOREIGN PATENT DOCUMENTS

| | | | |
|---|---|---|---|
| JP | 2004276396 | A | 10/2004 |
| JP | 201261848 | A | 3/2012 |
| JP | 201322861 | A | 2/2013 |

* cited by examiner

*Primary Examiner* — Thinh Nguyen
(74) *Attorney, Agent, or Firm* — Lowe Hauptman & Ham, LLP

(57) ABSTRACT

A printing device and a positioning method of a printing device can accurately compensate for deviation between the intended conveyance of the print medium and the actual movement of the print medium when conveyed. A printer 5 has a conveyance motor 32 that can selectively convey print media forward and reverse; and a control unit 101 controls the conveyance motor 32 to convey the print medium. The control unit 101 executes a specific sequence, and calculates the difference in the conveyance amount of the print medium in each direction when the conveyance unit is operated the same amount in both directions. This sequence includes changing from forward to reverse and from reverse to forward the same number of times, a first conveyance of the continuous paper M forward or reverse, and a second conveyance in the opposite direction as the first conveyance.

15 Claims, 12 Drawing Sheets

PRINTING DEVICE, PRINTHEAD, AND METHOD OF POSITIONING PRINT MEDIA IN A PRINTER

Priority is claimed under 35 U.S.C. §119 to Japanese Application nos. 2013-140362 filed on Jul. 4, 2013 and 2013-180017 filed on Aug. 30, 2013, which are hereby incorporated by reference in their entirety.

BACKGROUND

1. Technical Field

The present invention relates to a printing device, a printhead, and a method of positioning a print medium in the printing device.

2. Related Art

Printers that detect an indexing mark such as a notch or a position recognition marker disposed to the print medium and position the print medium based on the detected mark are known from the literature. See, for example, JP-A-2013-22861. The device taught in JP-A-2013-22861 detects the perforation or a slit formed between each page of a continuous medium such as fanfold paper or roll paper by an optical sensor disposed to the media conveyance path. After detection by the optical sensor, an operation for setting the position to cut a label after printing to the detected perforation, for example, is executed referenced to the detected position. Printers of this type can typically convey the print medium in both forward and reverse directions, but when the conveyance direction is changed to the opposite direction, the position can shift or slip due to backlash. To solve this problem, JP-A-2004-276396 teaches measuring and compensating for this backlash.

Printers that have a platen roller disposed opposite a printhead, and print while conveying the print medium held between the printhead and platen roller, are also common. This type of printer enters a standby mode while the print medium is held between the printhead and platen roller, and a long time can pass with the print medium held pressed against the printhead. As a result, when printing to a print medium with a coated printing surface that can easily stick when pressed and held against the printhead, and the printer is left in the standby mode for an extended time, the print medium may stick to the printhead. To solve this problem, JP-A-2012-61849 teaches removing print media that has stuck to the printhead by moving the printhead in a direction that changes the position in contact with the platen roller while the printhead is pressed against the platen roller.

Variation in the conveyance distance can also occur during print media conveyance for reasons other than backlash. For example, slipping can occur when conveying media in a specific conveyance direction due to the construction of the conveyance mechanism that conveys the print media. When the print medium is conveyed in a specific conveyance direction, this type of slippage is the difference between the conveyance amount of the operation conveying the print medium, and the actual amount that the print medium was conveyed (moved). If the actual conveyance amount differs according to the conveyance direction, this difference can result in a difference, between the intended conveyance amount and the actual conveyance amount. As a result, the actual position of the print medium may deviate from, the expected position even if control that sets the position of the print medium to a specific indexed position is applied. Because this deviation is not necessarily the same every time the conveyance direction changes and backlash occurs, accurate measurement is difficult.

The cumulative effect, of differences in the conveyance amount in each conveyance direction could conceivably be eliminated by conveying the print medium in only one direction for positioning without changing the conveyance direction. Because the print medium cannot be reversed in this configuration, the print medium may be conveyed a greater distance to reach the desired indexing position, and waste increases.

The printhead disclosed in JP-A-2012-61848 has a support frame to which the head unit is affixed, and the position of this support frame when the support frame moves is limited by stops formed on the inside surfaces of the side panels of the case. If there is variation in parts of the printhead, such as positioning error or twisting of the head unit, movement of the printhead may be limited by the stops and pressure may be uneven when the printhead is pushed to the platen roller, print quality may therefore drop, and media conveyance may be skewed.

SUMMARY

The present invention is directed to a printing device and a method of positioning media in the printing device that can accurately compensate for deviation between the amount of conveyance produced to convey the print medium and the actual movement of the print medium when conveyed.

Another object of the invention is to provide a printhead and a printing device that removes print media stuck to the printhead, maintains uniform pressure between the printhead and platen, and prevents a drop in print quality or skewing during media conveyance.

A first aspect of the invention is a printing device including: a conveyance unit that can change the conveyance direction and convey the print medium forward and reverse; and a control unit that controls the conveyance unit to convey the print, medium, executes a sequence including switching from forward to reverse, switching the same number of times from reverse to forward, a first conveyance that conveys the print medium forward or reverse, and a second conveyance in the opposite direction as the first conveyance, and based on the conveyance amount of the first conveyance and the conveyance amount of the second conveyance, calculates the difference in the conveyance amounts of the print medium in both directions when the conveyance unit operates the same amount in each direction.

Different amounts of slipping occur when the print medium is conveyed forward and when conveyed in reverse, and this configuration can accurately and easily calculate the difference in the conveyance amount of the print medium in each conveyance direction when the conveyance unit is operated the same amount in both directions. The difference in the conveyance amount that occurs when the conveyance direction changes, that is, deviation in the conveyance amount, can be accurately corrected. For example, the print medium can be conveyed to a desired position in combination with conveyance operations in different conveyance directions. The effect of backlash can also be cancelled because the sequence that calculates the difference in the conveyance amounts includes changing from forward to reverse and from reverse to forward the same number of times. As a result, the deviation that occurs for reasons other than backlash when changing the conveyance direction can be corrected more accurately.

Preferably, the printing device also has a detection unit that detects a position recognition marker disposed, to the print medium. The control unit starts the first conveyance from the position where the detection unit detects the position recognition marker, conveys the print medium, a specific amount in the first conveyance, and conveys the print medium in the second conveyance until the detection unit detects the position recognition marker.

When the conveyance unit is operated the same amount, this aspect of the invention can more accurately determine the difference in the conveyance amounts in each conveyance direction based on the position recognition markers disposed to the print medium, and can more appropriately compensate for variation that occurs when the conveyance direction changes.

Further preferably, the control unit executes an initializing conveyance forward or reverse, a first switching operation that changes the conveyance direction after the initializing conveyance, a first conveyance that conveys the print medium after the first switching operation, a second switching operation that changes the conveyance direction after the first conveyance, and a second conveyance that conveys the print medium after the second switching operation, and calculates the difference in the conveyance amounts of the print medium in both directions when the conveyance unit operates the same amount in each direction.

In this configuration, the conveyance direction is changed when transitioning from the initializing conveyance to the first conveyance at the beginning of the sequence, and the direction of the initializing conveyance before the sequence starts and the conveyance direction of the second conveyance therefore match. As a result, if the second conveyance is forward at the end of the sequence, for example, the print medium can be quickly conveyed forward without changing the conveyance direction after the sequence ends. By thus configuring the sequence that calculates the deviation according to the conveyance direction after the sequence ends, the deviation can be calculated more efficiently and the operation following completion of the sequence can be executed quickly.

In a printing device according to another aspect of the invention, the control unit executes an initializing conveyance forwarder reverse, a first conveyance that conveys the print medium in the same direction as the initializing conveyance, a first switching operation that changes the conveyance direction after the first conveyance, a second conveyance that conveys the print medium after the first switching operation, and a second switching operation that changes the conveyance direction after the second conveyance, a third conveyance that conveys the print medium after the second switching operation, and calculates the difference in the conveyance amounts of the print medium in both directions when the conveyance unit operates the same amount in each direction.

This configuration enables efficiently calculating the deviation by obtaining the difference between the actual conveyance amounts of the print medium when the conveyance unit is operated the same amount in the first and third conveyance operations, and the second conveyance operation. This method enables making the direction of the initializing conveyance before the sequence starts the same as the conveyance direction of the third conveyance at the end of the sequence. As a result, the final conveyance direction of the sequence can be made forward if conveying the medium forward at the beginning of the sequence is desirable. More specifically, the print medium can be quickly conveyed forward without changing the conveyance direction after the sequence ends. As a result, the sequence that calculates the deviation according to the conveyance direction after the sequence ends, the deviation can be calculated more efficiently and the operation following completion of the sequence can be executed quickly.

In a printing device according to another aspect of the invention, the control unit operates the conveyance unit only a preset amount in the first conveyance in the sequence, in the second conveyance operates the conveyance unit until the print medium returns to the position before the first conveyance started, and based on the difference in the operation of the conveyance unit in the first and second conveyance operations, calculates the difference in the conveyance amounts of the print medium in each conveyance direction when the conveyance unit operates the same amount in each direction.

So that operation of the conveyance unit in the first conveyance and the actual conveyance distance of the print medium in the first conveyance are the same, this aspect of the invention calculates the difference in the conveyance distance of the print medium in each conveyance direction from the difference in the operation of the conveyance unit when conveying in opposite directions. As a result, deviation occurring when the conveyance direction changes can be calculated and corrected referenced to the actual conveyance distance of the print medium.

In a printing device according to another aspect of the invention, the control unit conveys the print medium by the conveyance unit and positions the leading end of the print medium to the start print position based on the difference in the operating amounts of the conveyance unit obtained by executing the sequence.

This configuration enables changing the conveyance direction of the print medium to convey and accurately position the print medium. As a result, print media waste can be eliminated because the print position can be set to a position near the leading end of the print medium.

In a printing device according to another aspect of the invention, when positioning the leading end of the print medium to the start print position, the control unit sets the conveyance direction immediately before stopping the print medium at the start print position to the same direction as the conveyance direction when printing on the print medium.

This configuration is not affected by backlash when the printing operation starts because there is no need to change the conveyance direction to print to print media set to the start print position. Printing can therefore proceed quickly and accurately after positioning.

A printing device according to another aspect of the invention preferably also has a print head that prints in contact with the print medium; and a platen roller that holds and conveys the print medium together with the printhead; the printhead being movable to the side separating from the platen roller when conveying the print medium in reverse.

In a configuration in which the print medium is held and conveyed between a printhead and platen roller, this configuration can pull the print medium from the printhead by moving the printhead when conveying in reverse, and if the print medium is stuck to the printhead, the print medium can be unstuck. Slipping occurs easily in this configuration because the force nipping the print medium is released when conveying the print medium in reverse. More specifically, deviation occurs easily between the actual conveyance distance of the print medium and the rotation of the platen roller during reverse conveyance, deviation does not occur easily during forward conveyance, and a difference in the conveyance distances due to the conveyance direction results. This configuration enables accurately calculating the difference in the conveyance amount of each conveyance direction in a configuration that can unstick the print medium as described above.

A printing device according to another aspect of the invention preferably also has a printhead; a platen roller in the conveyance unit; and a support mechanism that pushes the printhead toward the platen roller wherein the conveyance unit can change the direction of platen roller rotation forward and reverse; and the support mechanism supports the printhead to separate from the platen roller when the platen roller turns in reverse.

In a configuration that holds and conveys the print medium between the printhead and platen roller, this configuration enables unsticking the print medium by turning the platen roller in reverse when the print medium is stuck to the printhead. Because the printhead and the platen roller separate when the platen roller turns in reverse in this configuration, a difference in the conveyance amount occurs depending on the conveyance direction, but this difference in conveyance amount can be obtained, and the difference in conveyance amounts can be corrected.

Another aspect of the invention is a printhead including: a support mechanism including a print unit that prints on a print medium, and a head unit opposite a platen roller that conveys the print medium, and supports and presses the head unit to the platen roller; wherein the support mechanism has a support unit that supports a pivot point disposed substantially in the widthwise center of the head unit, which extends in a direction intersecting the conveyance direction of the print medium, and supports the head unit freely rockably on the pivot point and movably in a direction that changes the position contacting the platen roller while pressing the head unit to the platen roller.

Because the head unit is supported so that it can rock freely on the pivot point on the transverse axis, this aspect of the invention can press the head unit evenly to the platen roller. As a result, uniform pressure can be maintained between the head unit and the platen roller, and a drop in print quality and skewing of the conveyed media can be prevented.

Furthermore, because the support mechanism supports the head unit movably in a direction that changes the point of contact with the platen roller while keeping the head unit pressed to the platen roller, when the print medium is stuck to the head unit, the portion of the print medium that is stuck (the portion to which pressure is applied) can be released from pressure from the platen roller. When the pressure is released, the print medium can be moved in a direction peeling the print medium from the head unit. When peeling the print medium off, the print medium can be easily unstuck because the print medium can be separated with less force than needed when separated by shear force alone.

In this aspect of the invention, the support mechanism preferably moves the head unit as a result of the platen roller turning in the first direction, or turning in a second direction that is the opposite of the first direction.

This configuration can unstick print media stuck to the head unit using a conveyance operation of an existing platen roller, and does not need a new drive source to move the head unit. A complicated device configuration is therefore not necessary, and print media can be unstuck at low cost.

Further preferably, the support unit has an incline that slopes in the direction away from the platen roller, and guides the pivot point along the incline.

When the pivot point is guided by the incline and moved to the pressure position in this configuration, the head unit separates from the platen roller. As a result, the angle to the stuck surface of the print medium increases, greater force is applied from the head unit separating the print medium, and the print medium can be quickly unstuck.

In addition, both the operation that rocks the head unit, and the operation that moves the head unit in the direction that changes the point of contact with the platen roller, can be achieved by the support unit and the pivot point disposed to the head unit, and device configuration can be simplified.

A printing device according to another aspect of the invention includes a platen roller that conveys a print medium, and a printhead with a head unit that is opposes the platen roller and has a print unit that prints on the print medium. The printhead has a support mechanism that supports and presses the head unit against the platen roller. The support mechanism has a support unit that supports a pivot point disposed substantially in the widthwise center of the head unit, which extends in a direction intersecting the conveyance direction of the print medium, and supports the head unit freely rockably on the pivot point and movably in a direction that changes the position contacting the platen roller while pressing the head unit to the platen roller.

Because the head unit is supported so that it can rock freely on the pivot point in a direction intersecting the conveyance direction of the print medium, this aspect of the invention can press the head unit evenly to the platen roller. As a result, uniform pressure can be maintained between the head unit and the platen roller, and a drop in print quality and skewing of the conveyed media can be prevented.

Furthermore, because the support mechanism supports the head unit movably in a direction that changes the point of contact with the platen roller while keeping the head unit pressed to the platen roller, the print medium can easily unstuck.

A printing device according to another aspect of the invention includes a conveyance unit having a platen roller that conveys a print medium, and changes driving the platen roller in forward and reverse; a printhead opposite the platen roller; a support mechanism that supports and presses a head unit of the printhead to the platen roller; and a control unit that controls the conveyance unit to convey the print medium; wherein the support mechanism has a support unit that supports a pivot point disposed substantially in the middle of the head unit, which extends in a direction intersecting the conveyance direction of the print medium, and supports the head unit movably in a direction that changes the position contacting the platen roller while supporting the head unit freely rockably on the pivot point and pressing the head unit to the platen roller; and the control unit executes a sequence including switching from forward to reverse, switching the same number of times from reverse to forward, a first conveyance that conveys the print medium forward or reverse, and a second conveyance in the opposite direction as the first conveyance, and based on the conveyance amount of the first conveyance and the conveyance amount of the second conveyance, calculates the difference in the conveyance amounts of the print medium in both directions when the conveyance unit operates the same amount in each direction.

Because the head unit, is supported so that it can rock freely on the pivot point on the transverse axis, this aspect of the invention can press the head unit evenly to the platen roller. As a result, uniform pressure can be maintained between the head unit and the platen roller, and a drop in print quality and skewing of the conveyed media can be prevented.

Furthermore, because the support mechanism supports the head unit movably in a direction that changes the point of contact with the platen roller while keeping the head unit pressed to the platen roller, when the print medium is stuck to the head unit, the portion of the print medium that is stuck (the portion to which pressure is applied) can be released from pressure from the platen roller. When the pressure is released, the print medium can be moved in a direction peeling the print medium from the head unit. When peeling the print medium off, the print medium can be easily unstuck, because the print medium can be separated with less force than needed when separated by shear force alone.

Because slippage differs when the platen roller turns forward and when the platen roller turns in reverse due to movement of the head unit, a difference in the conveyance amount in each conveyance direction also occurs, but this configuration can accurately and easily calculate the conveyance difference. As a result, the difference in conveyance amounts can be accurately corrected. The effect of backlash can also be cancelled because the sequence that calculates the difference in the conveyance amounts includes changing from forward to reverse and from reverse to forward the same number of times, and the deviation that occurs for reasons other than backlash when changing the conveyance direction can be corrected more accurately.

In a printing device according to another aspect of the invention, the support mechanism preferably moves the head unit as a result of the platen roller turning in the first direction, or turning in a second direction that is the opposite of the first direction.

This configuration can unstick print media stuck to the head unit using a conveyance operation of an existing platen roller, and does not need a new drive source to move the head unit. A complicated device configuration is therefore not necessary, and print media can be unstuck at low cost.

In a printing device according to another aspect of line invention, the support unit has an incline that slopes in the direction away from the platen roller, and guides the pivot point along the incline.

When the pivot point is guided by the incline and moved to the pressure position in this configuration, the head unit separates from the platen roller. As a result, the angle to the stuck surface of the print medium increases, greater force is applied from the head unit separating the print medium, and the print medium can be quickly unstuck.

In addition, both the operation that rocks the head unit, and the operation that moves the head unit in the direction that changes the point of contact with the platen roller, can be achieved by the support unit and the pivot point disposed to the head unit, and device configuration can be simplified.

Another aspect of the invention is a positioning method of a printing device having a conveyance unit that can convey a print medium in forward and reverse directions, and a sensor that is disposed to the conveyance path of the print medium and detects a detection mark disposed on the print medium, the positioning method including:

switching the conveyance direction from forward to reverse;

switching the same number of times from reverse to forward; a first conveyance that conveys the print medium forward or reverse; a second conveyance in the opposite direction as the first conveyance; calculating the difference in the conveyance amounts of the print medium in both directions when the conveyance unit operates the same amount in each direction based on the conveyance amount of the first conveyance and the conveyance amount of the second conveyance; and a leading end positioning operation that aligns the leading end of the print medium with a specific position based on a compensation amount that compensates for the calculated difference.

Different amounts of slipping occur when the print medium is conveyed forward and when conveyed in reverse, and this configuration can accurately and easily calculate the difference in the conveyance amount of the print medium in each conveyance direction. The difference in the conveyance amount that occurs when the conveyance direction changes, that is, deviation in the conveyance amount, can be accurately corrected. For example, the print medium can be conveyed to a desired position in combination with conveyance operations in different conveyance directions. The effect of backlash can also be cancelled because the sequence that calculates the difference in the conveyance amounts includes changing from forward to reverse and from reverse to forward the same number of times. As a result, the deviation that occurs for reasons other than backlash when changing the conveyance direction can be corrected mere accurately.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Embodiment 1

Figure 1:
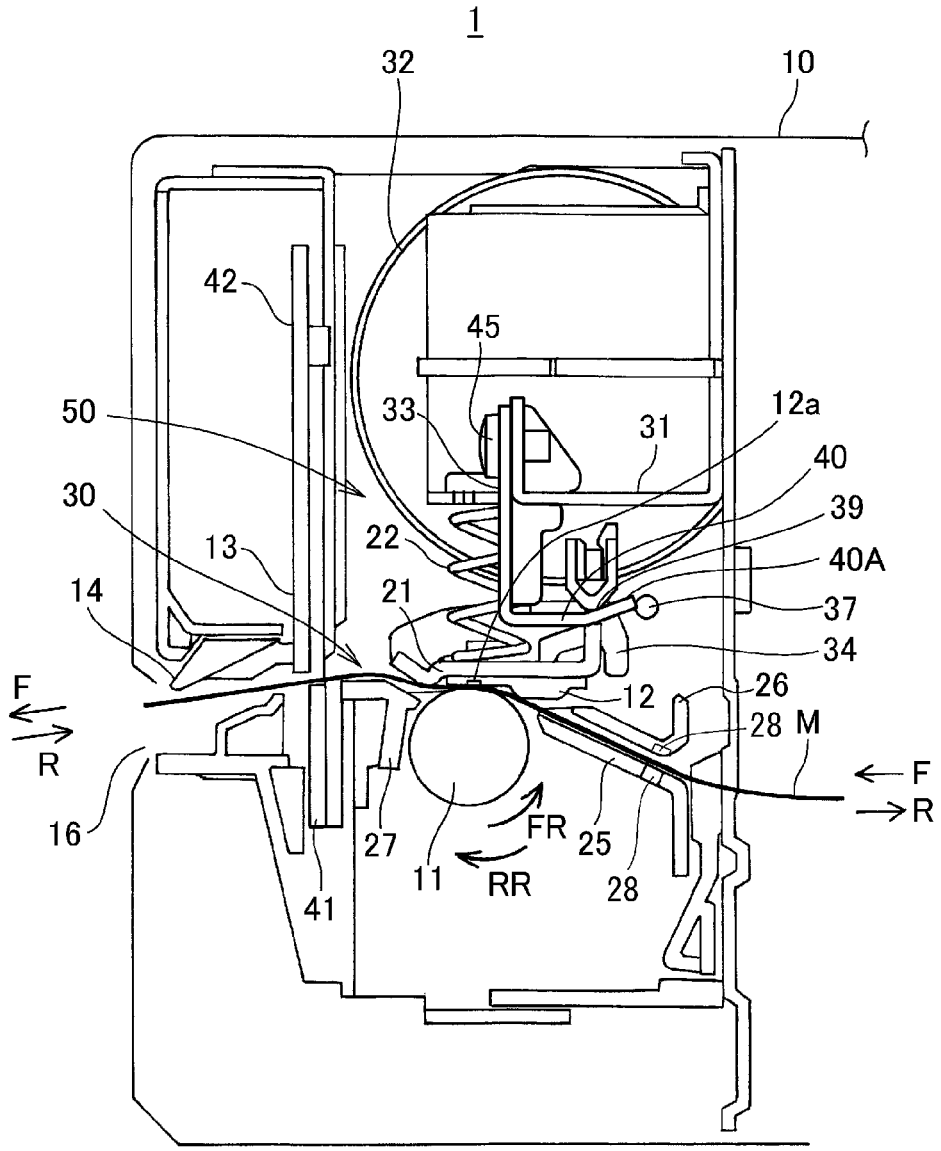
FIG. 1 is a side section view of main parts of a printer according to the invention.
Figure 2:
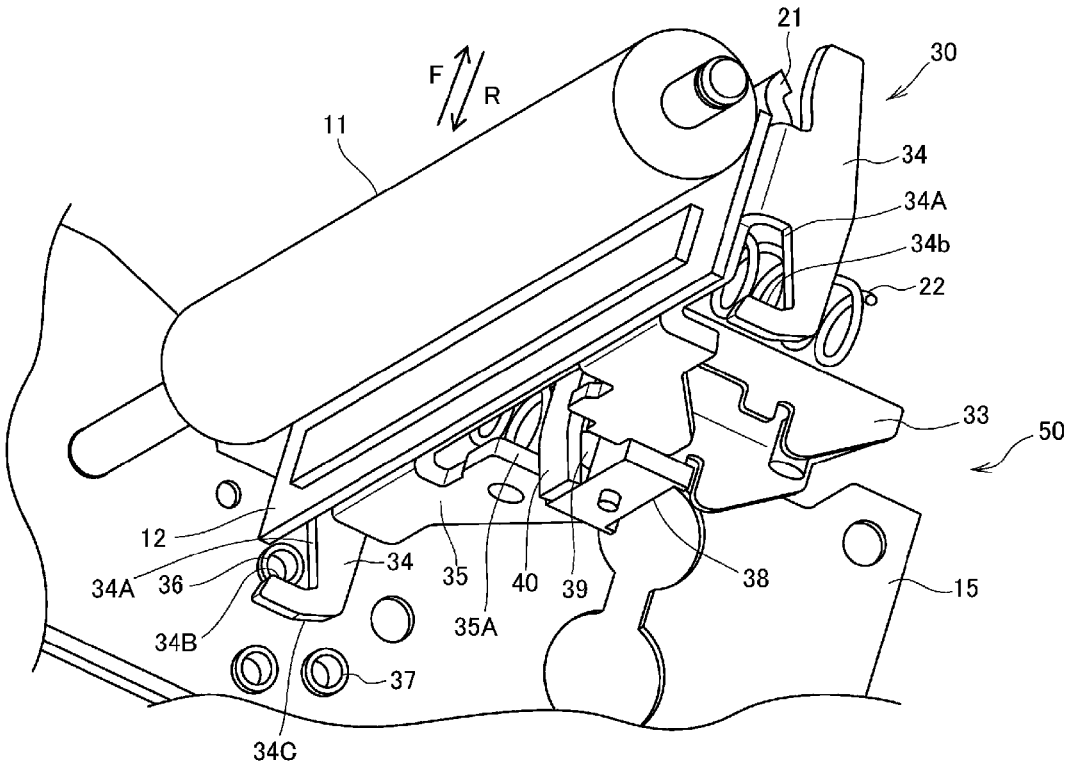
FIG. 2 is an oblique view showing the configuration of the platen roller and printhead.

FIG. 1 is a side section view showing ma in parts in the configuration of a printer 1 (printing device) according to a first embodiment of the invention, and FIG. 2 is an oblique view showing the relative positions of the platen roller 11 and printhead 30. FIG. 1 is a side view of the configuration inside the case 10 of the printer 1. The left side of the printer as shown in FIG. 1 is the front of the printer 1.

The printer 1 has functional units including the platen roller 11, the printhead 30, an automatic cutter 13, and a manual cutter 14 inside a basically box-shaped case 10. The printer 1 conveys continuous paper M used as the print medium by rotation of the platen roller 11, and prints text or images on the printing surface of the continuous paper M with the printhead 30. The printed continuous paper M is then discharged from a paper exit 16 open in the front of the case 10.

The continuous paper M is held in a paper storage unit (not shown in the figure) configured in the back inside of the case 10, or a paper tray (not shown in the figure) disposed externally to the back of the case 10. The continuous paper M is continuous paper such as fanfold paper or roll paper, may have a coated surface, and may be a non-paper medium such as a plastic sheet, for example. The continuous paper M in this embodiment of the invention is thermal paper, and produces color when heated by the printhead 30. In one example, the continuous paper M in this embodiment has forms of a specific length connected end to end as continuous paper. This continuous paper M is perforated at regular intervals along the length of the medium, and the perforations are the seams between the forms. Oval holes indicating where the seams between forms are located are formed as position recognition markers. The continuous paper M is also folded at the perforations into fanfold paper.

The printhead 30 is disposed with the platen roller 11 in substantially the middle of the case 10. The printhead 30 has a head unit 12 attached to a sheet metal base 21, and the base 21 is movably supported as described below by the left and right side frames 15 (FIG. 2) of the case 10.

The head unit 12 of the printhead 30 extends in the direction (the axial direction of the platen roller 11) crosswise to the conveyance direction of the continuous paper M, and is disposed opposite the platen roller 11 with the continuous paper M conveyance path therebetween. The platen roller 11 is also disposed between the pair of side frames 15 of the case 10 (FIG. 2), and is supported rotatably.

A spring 22 (urging member) is disposed between the base 21 of the printhead 30 and a top frame 31 located in the top part of the case 10. The spring 22 is a compression spring with one end affixed to the top frame 31. As a result, the spring 22 pushes the base 21 toward the platen roller 11, and the head unit 12 of the printhead 30 is pushed against the platen roller 11 by the force of the spring 22.

The platen roller 11 is connected through a drive gear train not shown to the conveyance motor 32 disposed inside the case 10. The platen roller 11 rotates when driven by the conveyance motor 32.

The platen roller 11 is pressed against the head unit 12 of the printhead 30 as described above, and the continuous paper M is held between the head unit 12 and the platen roller 11. When the conveyance motor 32 is driven and the platen roller 11 turns, the continuous paper M is conveyed in conjunction with rotation of the platen roller 11. The surface of the platen roller 11 is covered by an elastomer or other elastic material with a high friction coefficient. This combined with the platen roller 11 and the head unit 12 being pushed together by the force of the spring 22 causes the continuous paper M to be conveyed by the platen roller 11 without slipping.

Figure 9:
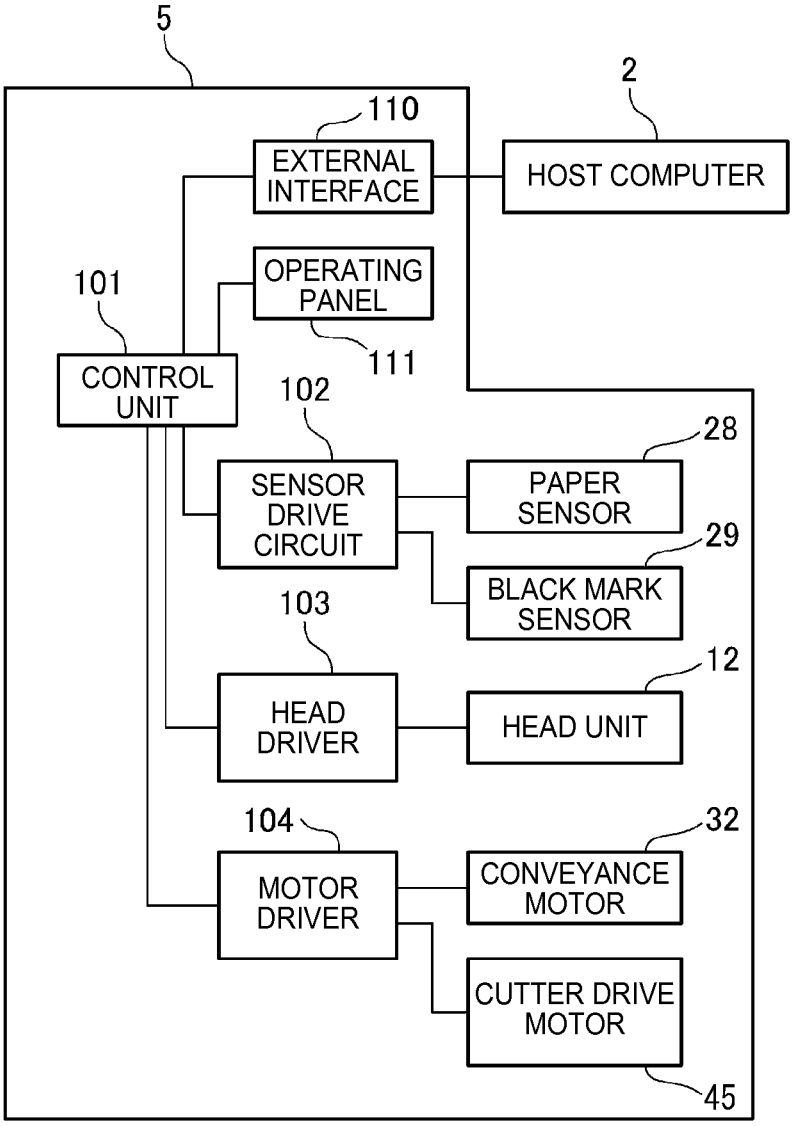
FIG. 9 is a function block diagram of the control system of a printer according to the invention.

The conveyance motor 32 can rotate in forward and reverse rotation directions by changing the direction of rotation as controlled by the control unit (FIG. 9). The platen roller 11 therefore rotates in the forward rotation direction as indicated by arrow FR in the figure, and the reverse rotation direction as indicated by arrow RR. When the platen roller 11 turns forward (FR), the continuous paper M is conveyed forward as indicated by arrows F in the figures. When the platen roller 11 turns in reverse (RR), the continuous paper M is conveyed in reverse as indicated by arrows R in the figures. The forward direction (FR) of the platen roller 11 and the forward, direction (F) of the continuous paper M is the conveyance direction when printing on the continuous paper M.

A pair of paper guides 25, 26 that guide the continuous paper M to the head unit 12 are disposed behind the platen roller 11 and head unit 12. Paper guide 25 is located on the bottom side of the conveyance path of the continuous paper M, and the other paper guide 26 is located above the conveyance path of the continuous paper M. The continuous paper M is conveyed from behind the head unit 12 through the gap between the paper guides 25, 26 to between the platen roller 11 and head unit 12, and is held (nipped) and conveyed between the platen roller 11 and head unit 12.

A paper sensor 28 (a detection unit) is also disposed to the paper guides 25, 26. The paper sensor 28 is a reflective or transmissive photosensor, and sensor output changes according to whether or not continuous paper M is between the paper guides 25, 26. As a result, the presence of continuous paper M between the paper guides 25, 26 can be detected based on the output of the paper sensor 28. Note that in this embodiment the paper sensor 28 is a transmissive photosensor.

The printing surface of the continuous paper M contacts the head unit 12. The head unit 12 has a plurality of heat elements 12*a* (print units) arrayed width wise to the continuous paper M, and the heat elements 12*a* are selectively driven to heat the printing surface of the continuous paper M and print text, images, or other content.

A paper guide 27 is also disposed below the continuous paper M in front of the platen roller 11, that is, on the downstream side in the conveyance direction, and the automatic cutter 13 is disposed in front (on the downstream side) of the paper guide 27.

The automatic cutter 13 includes a fixed knife 41 disposed below the continuous paper M, a movable knife 42 disposed above the continuous paper M, and a cutter drive motor (not shown in the figure) that drives the movable knife 42. When the cutter drive motor (not shown in the figure) turns as controlled by the control unit described below, the movable knife 42 pivots to the continuous paper M and cuts the continuous paper M.

The manual cutter 14 is disposed in front of (downstream of) the automatic cutter 13. The manual cutter 14 is inside the paper exit 16, and is a knife that protrudes down from above the continuous paper M. The manual cutter 14 is provided for manually cutting the continuous paper M without using the automatic cutter 13.

When the continuous paper M discharged from the paper exit 16 is taken by the operator using the printer 1 and pulled up against the manual cutter 14, the continuous paper M is cut by the manual cutter 14.

The support structure of the printhead 30 is described next.

As shown in FIG. 1, the printhead 30 has a support mechanism 50 that supports and presses the head unit 12 against the platen roller 11. The support mechanism 50 includes the flat base 21 that supports the head unit 12; the spring 22 that urges the base 21 to the platen roller 11; and a support frame 33 affixed to the top frame 31 to which one end of the spring 22 is attached.

As shown in FIG. 2, the base 21 has side members 34 formed by bending the opposite widthwise sides of the base 21, and a tongue 35 formed by bending the end located on the upstream side in the reference conveyance direction of the continuous paper M (also referred to below as the upstream side in the continuous paper M conveyance direction). The side members 34 are respectively disposed facing the side frames 15 of the case 10. A notch 34A is formed in each side member 34 on the upstream conveyance side of the continuous paper M, and a pin 36 (protrusion) protruding from the corresponding side frame 15 fits into each notch 34A. The pins 36 contact the inside edge 34B of the corresponding notch 34A, and thus prevent the side members 34 from moving further to the downstream side in the reference conveyance direction of the continuous paper M (also referred to below as the downstream side in the continuous paper M conveyance direction). As a result, the head unit 12 is pushed to the platen roller 11 by the urging force of the spring 22, movement of the head unit 12 to the downstream side in the continuous paper M conveyance direction (in the direction of arrows F) is limited by the side members 34 and pin 36, and the head unit 12 is held in the appropriate position.

Note that the position where the pins 36 contact the inside edges 34B of the notches 34A is the normal, print position of the printhead 30.

Because the notches 34A are larger than the pins 36, the side members 34 can move in the direction in which the pins 36 move inside the notches 34A. More specifically, the side members 34 can slide to the upstream conveyance side of the continuous paper M (the direction of arrow R).

Another pin 37 (protrusion) is disposed to the side frames 15 on the upstream side of the pin 36 in the continuous paper M conveyance direction, and at a different vertical position. When the side members 34 move to the upstream side in the continuous paper M conveyance direction, the pins 37 contact the outside edge 34C of the corresponding side member 34, and prevent the side members 34 from moving further to the upstream side in the continuous paper M conveyance direction. The printhead 30 (head unit 12) in this embodiment is thus configured to move in the conveyance direction of the continuous paper M through a range of movement limited by the two pins 36, 37.

Figure 3:
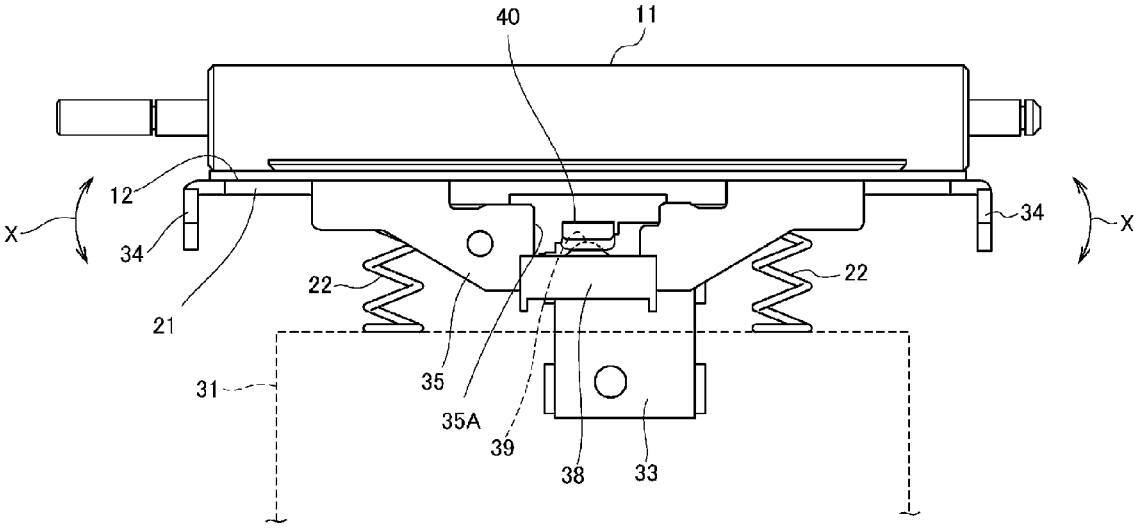
FIG. 3 shows the platen roller and printhead shown in FIG. 2 from the upstream side of the print medium conveyance direction.

As shown in FIG. 3, the tongue 35 has an opening 35A formed substantially in the middle, and a pivot point 39 is disposed protruding into the opening 35A at the edge of the opening 35A on the side far from the platen roller 11. This pivot point 39 is, for example, a plastic piece affixed to a mounting bracket 38, and is disposed by attaching the mounting bracket 38 at the edge of the opening 35A. Mote that the pivot point 39 is not limited to a plastic piece formed separately from the mounting bracket 38, and could be formed in unison with the same member as the mounting bracket.

As shown in FIG. 1, the support frame 33 is fastened by a screw 45 to the top frame 31. The support frame 33 has a support piece (support unit) 40 bent to the upstream side in the continuous paper M conveyance direction behind the head unit 12, and this support piece 40 extends inside the opening 35A of the tongue 35 and contacts the pivot point 39.

As shown in FIG. 3, the head unit 12 in this embodiment is pushed against the platen roller 11 by a pair of springs 22 through the base 21, and the pivot point 39 disposed between the springs 22 contacts the support piece 40 of the support frame 33. As a result, the head unit 12 can rock on the pivot point 39 in the same direction X (FIG. 3) as the springs 22 expand, and contract, and can press the head unit 12 evenly against the platen roller 11. As a result, even when there is variation in the installation precision or twisting of parts in the head unit 12, these deviations can be absorbed, the head unit 12 can be pressed evenly against the platen roller 11, and misprints and skewing the continuous paper M can therefore be prevented.

The notches 34A formed in the side members 34 are large enough that only the above-described inside edge 34B contacts the pin 36. As a result, when the head unit 12 rocks, the pin 36 does not restrict the rocking action, and the head unit 12 can be pressed evenly against the platen roller 11.

As shown in FIG. 1, the support piece 40 also has an inclined face 40A that slopes so that the distal end is farther from the platen roller 11 than the base end. As a result, when the side members 34 move to the upstream side in the continuous paper M conveyance direction, the pivot point 39 is guided by the inclined face 40A and the head unit 12 moves away from the platen roller 11.

The operation removing continuous paper M stuck to the head unit 12 is described next.

Because the printer 1 is configured to hold the printing surface of the continuous paper M against the head unit 12, the continuous paper M can stick to the head unit 12 if the continuous paper M is not conveyed and remains held stationary against the head unit 12 for long, preventing the continuous paper M from sliding over the surface of the head unit 12. The printer 1 according to the invention is therefore configured with a mechanism for unsticking the medium.

Figure 4:
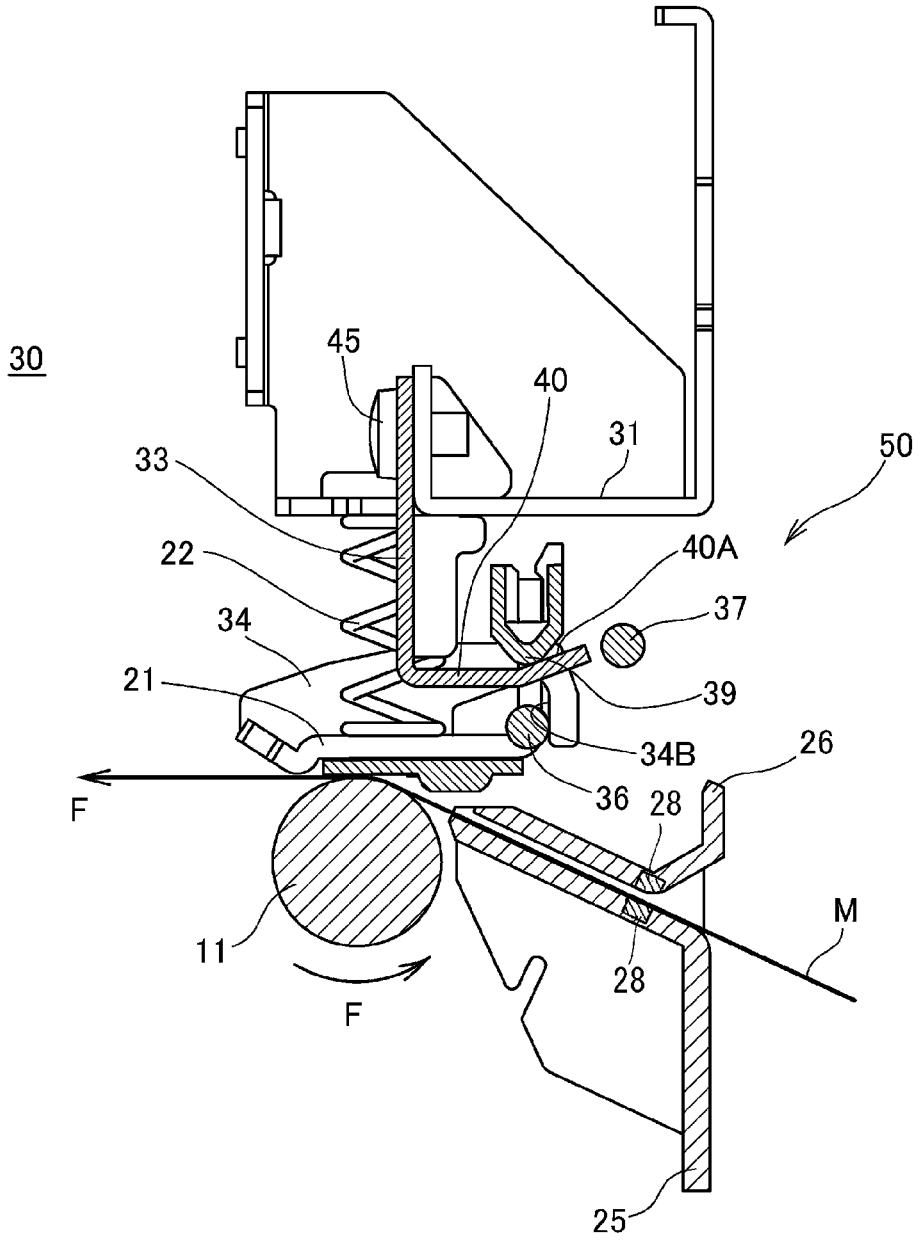
FIG. 4 is an enlarged section view of main parts of the printer.

FIG. 4 illustrates rotation of the platen roller 11 in the forward direction (FR). More specifically, FIG. 4 shows when the platen roller 11 is rotating in the forward direction (FR), and after rotation in the forward direction (FR) stops. When the platen roller 11 turns in the reverse direction (RR), the head unit 12, base 21, and side members 34 move in unison to the back to the positions shown in FIG. 5.

Figure 5:
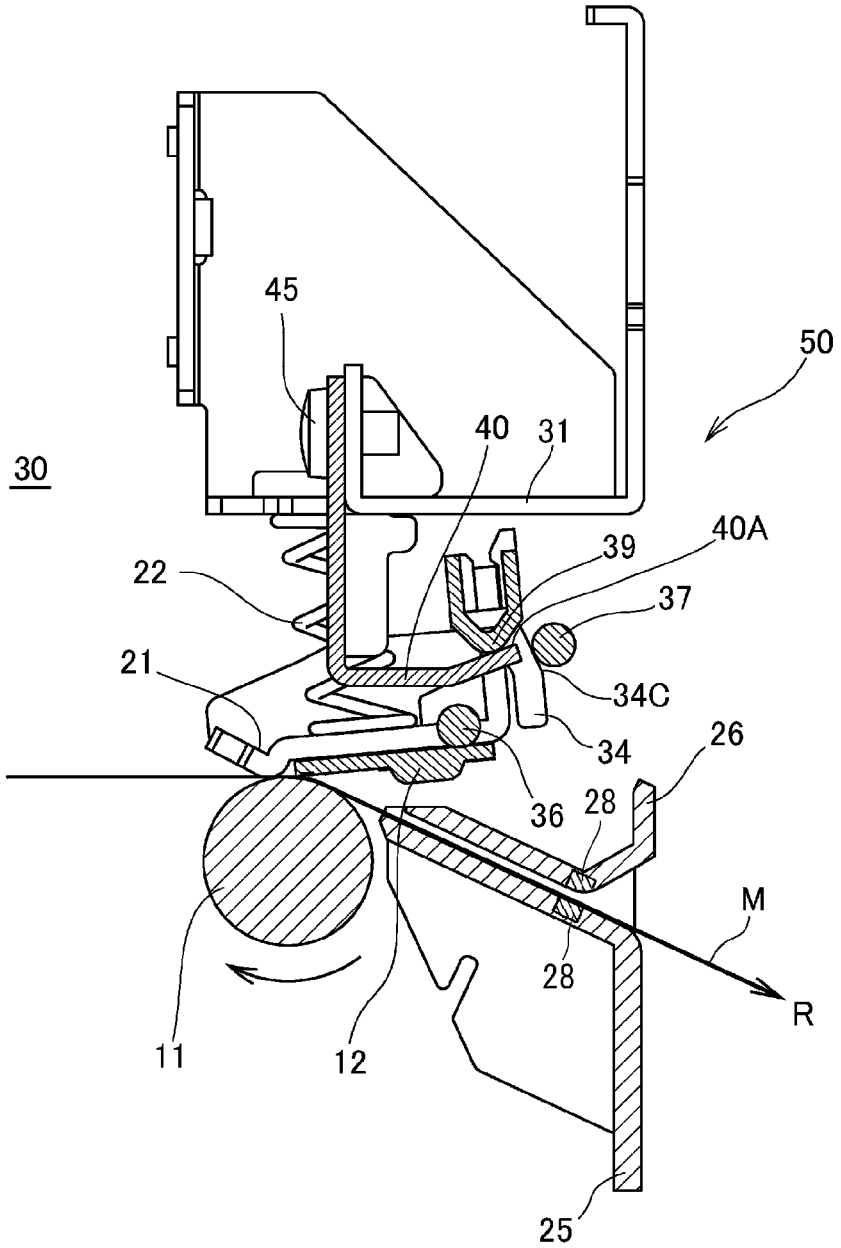
FIG. 5 is an enlarged section view of main parts of the printer.

In this configuration the support frame 33 has a support piece 40 that contacts the pivot point 39 disposed to substantially the middle of the transverse axis of the base 21, which extends on the transverse axis intersecting the conveyance direction of the continuous paper M. As shown in FIG. 4 and FIG. 5, this support piece 40 has an inclined face 40A that slopes so that the distal end is farther from the platen roller 11 than the base end.

When the platen roller 11 turns in the reverse direction (RR) (first direction), the head unit 12 and base 21 move to the upstream side of the continuous paper M conveyance direction, and the pivot point 39 is guided over the inclined face 40A. As a result, the head unit 12 moves with the side members 34 to the back and up, and moves in the direction away from the platen roller 11 (direction changing the position that contacts the platen roller). The force of the spring 22 is directed to the nipping point between the platen roller 11 and the head unit 12 in the state shown in FIG. 4, but in the state shown in FIG. 5, the force of the spring 22 is directed in a direction away from the platen roller 11 because the spring 22 is tilted. Therefore, by moving the head unit 12 to the back, the force holding the platen roller 11 and head unit 12 together decreases, and pressure from the platen roller 11 is released.

If the platen roller 11 turns in the reverse direction (RR) when the printing surface of the continuous paper M is stuck to the head unit 12 in the state shown in FIG. 4, the continuous paper M becomes unstuck from the head unit 12. More specifically, because the head unit 12 moves away from the platen roller 11 when the platen roller 11 turns in reverse, the pressure at the posit ion pressing the continuous paper M to the head unit 12 weakens, and the continuous paper M can be more easily separated from the head unit 12. The continuous paper M is also guided downward by the paper guide 26 due to the reverse (R) conveyance force. As a result, the continuous paper M separates from the head unit 12 when the continuous paper M is conveyed. By thus rotating the platen roller 11 in the reverse direction (RR), the printer 1 can easily unstick the continuous paper M from the head unit 12. By repeatedly turning the platen roller 11 in the reverse direction (RR) and then in the forward direction (FR) (second direction), the continuous paper M can be more reliably unstuck from the head unit 12.

As described above, a printer 1 according to the first embodiment of the invention has a platen roller 11 that conveys continuous paper M, and a printhead 30 having a head unit 12 that has heat elements 12*a* for printing on the continuous paper M and is disposed opposite the platen roller 11.

The printhead 30 also has a support mechanism 50 that supports and presses the head unit 12 to the platen roller 11. The support mechanism 50 has a support piece 40 that supports a pivot point 39 disposed to substantiality the middle of the transverse axis of the base 21, which extends on the transverse axis intersecting the conveyance direction of the continuous paper M.

Because the head unit 12 is thus supported to rock freely on the pivot point 39, the head unit 12 can be pressed evenly against the platen roller 11, uniform pressure between the head unit 12 and platen roller 11 can be maintained, and a drop in print quality and skewing of the conveyed media can be prevented. Furthermore, because the support mechanism 50 supports the head unit 12 movably to the upstream side in the continuous paper M conveyance direction by rotating the platen roller 11 in reverse when the head unit 12 is pressed against the platen roller 11, the support mechanism 50 can easily unstick the print medium.

Because the support mechanism 50 moves the head unit 12 to the upstream side in the continuous paper M conveyance direction by guiding the pivot point 39 along the opposing surface of the support piece 40, this embodiment of the invention can execute both the operation that rocks the head unit 12 and the operation that moves the head unit 12 by the pivot point 39 and support piece 40 disposed to the head unit 12, and construction can therefore be simplified.

In this embodiment, the support mechanism 50 moves the head unit 12 to the upstream side in the continuous paper M conveyance direction by rotating the platen roller 11 in the reverse direction (RR), can therefore execute the operation unsticking media from the head unit 12 by a conveyance operation using the existing platen roller 11, and providing a separate new drive source for moving the head unit 12 is not necessary. There is therefore no need to complicate device construction, and media can be unstuck at low cost.

Because the support piece 40 has a inclined face 40A that slopes away from the platen roller 11, and guides the pivot point 39 over the inclined face 40A in this embodiment of the invention, the head unit 12 separates from the platen roller 11 in conjunction with the pivot point 39 sliding along the inclined face 40A and moving the pressure point. As a result, the angle between the head unit 12 and the sticking surface of the continuous paper M increases, greater force works to separate the continuous paper M from the head unit 12, and the continuous paper M can be quickly unstuck.

The position where the continuous paper M sticks to the head unit 12 around the heat elements 12*a* is not limited in this example to where the heat elements 12*a* are disposed. This embodiment pulls and moves the head unit 12 by the conveyance force used to convey the continuous paper M, but a configuration in which a drive source separate from the continuous paper M conveyance means moves the head unit 12 and moves the contact position with the platen roller 11 is also conceivable.

Embodiment 2

A second embodiment of the invention is described next with reference to FIG. 6 to FIG. 8. Note that like parts in this and the printer 1 according to the first embodiment described above are identified by like reference numerals, and further description thereof is omitted.

Figure 6:
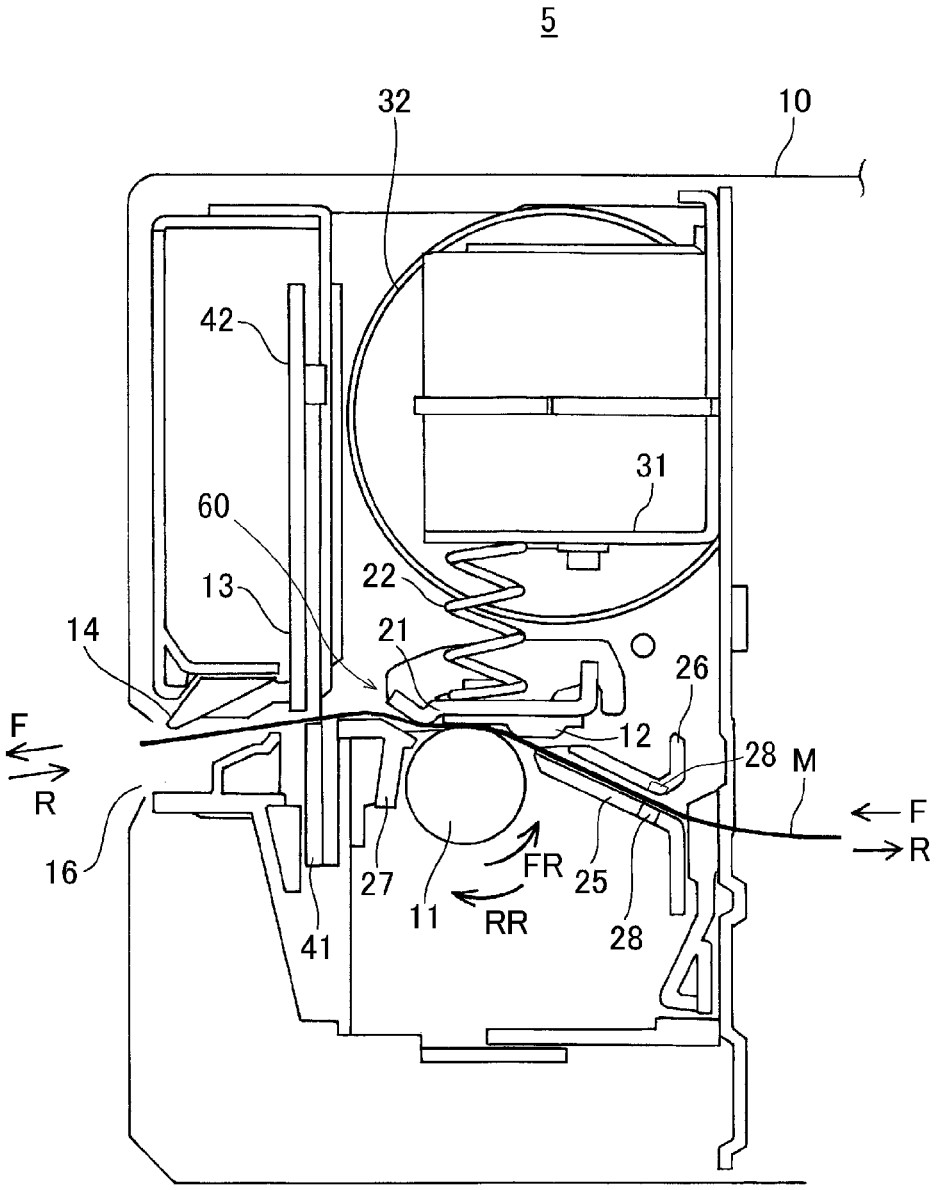
FIG. 6 is an enlarged section view of main parts of the printer in a second embodiment of the invention.

FIG. 6 is a side section, view showing main parts in the configuration of a printer 5 (printing device) according to this embodiment of the invention. FIG. 6 shows a side view of the configuration inside the case 10 of the printer 5. The left side in FIG. 6 is the front of the printer 5.

Similarly to printer 1, this printer 5 has functional units including the platen roller 11, a printhead 60, an automatic cutter 13, and a manual cutter 14 inside a basically box-shaped case 10. The printer 5 conveys continuous paper M used as the print medium by rotation of the platen roller 11, and prints text or images on the printing surface of the continuous paper M with the printhead 60. The printed continuous paper M is then discharged from a paper exit 16 open in the front of the case 10.

The printhead 60 is disposed with the platen roller 11 substantially in the middle of the case 10. The printhead 60 has a head unit 12 like printhead 30, and the configuration around the head unit 12 is the same as with printhead 30.

Figure 7:
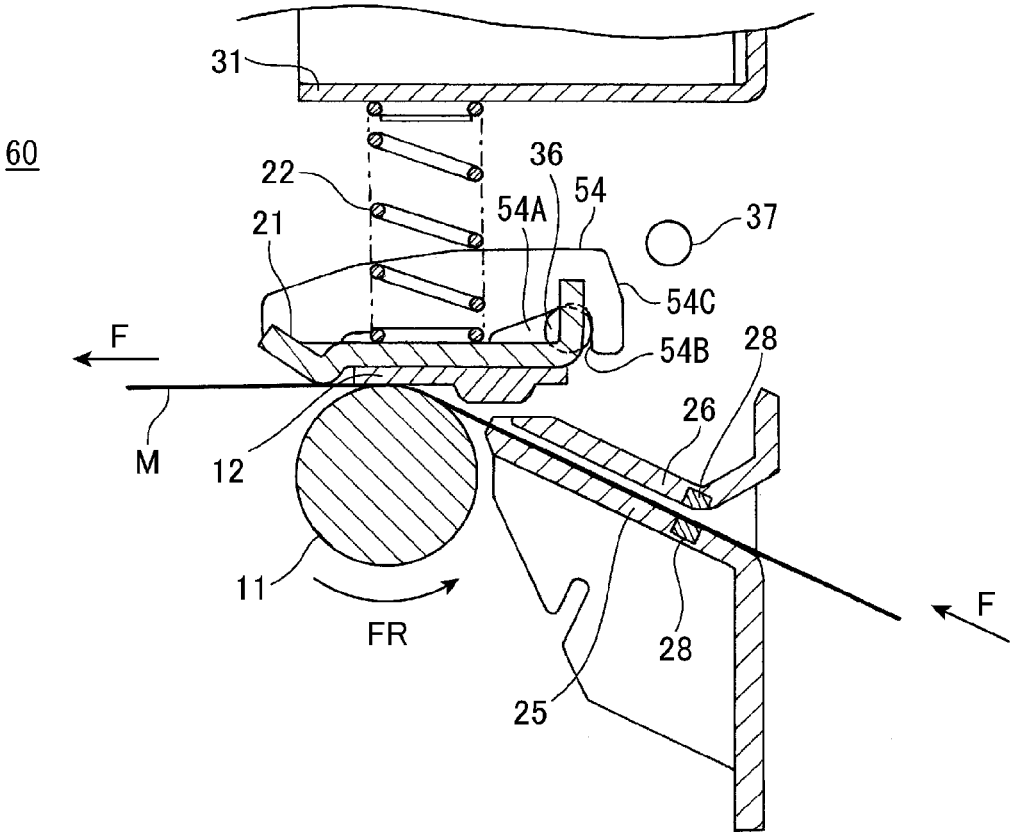
FIG. 7 is an enlarged section view of main parts of the printer according to the second embodiment of the invention.
Figure 8:
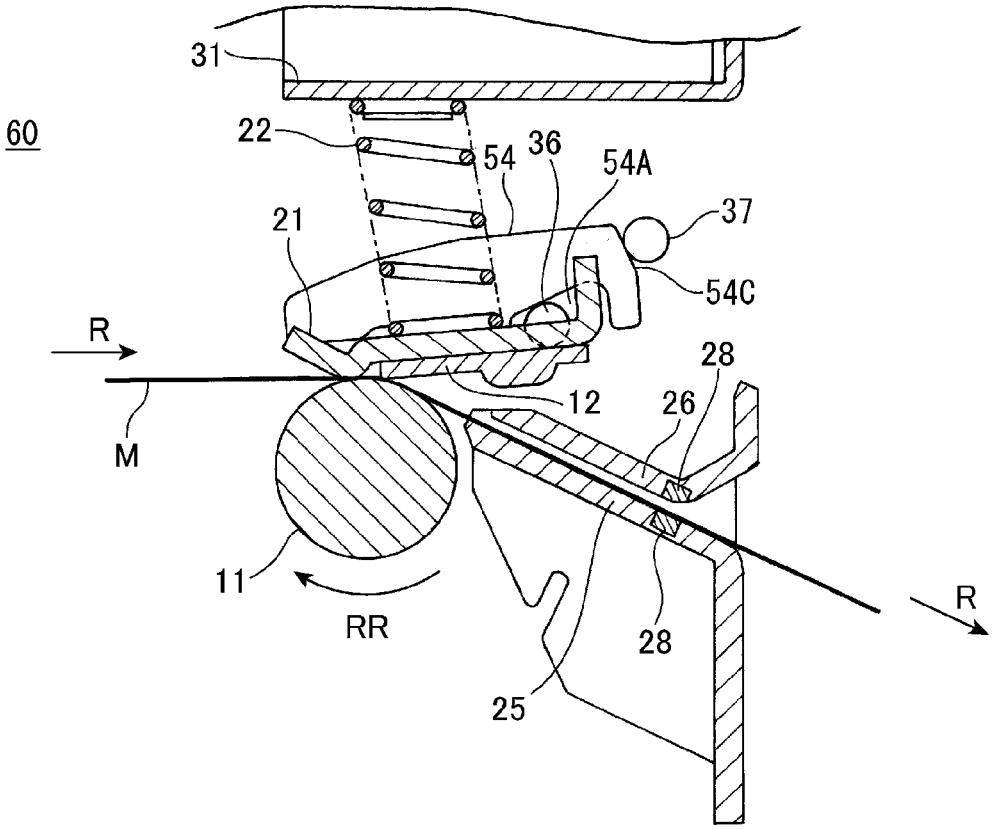
FIG. 8 is an enlarged section view of main parts of the printer according to the second embodiment of the invention.

FIG. 7 and FIG. 8 are enlarged section views of part of the printer 5 showing particularly the head unit 12 of the printhead 60 and surroundings.

The printer 5 is configured so that the printing surface of the continuous paper M is pressed against the head unit 12. As described in the printer 1 above, the continuous paper M can stick to the head unit 12 if the continuous paper M is not conveyed and remains held stationary against the head unit 12 for long, preventing the continuous paper M from sliding over the surface of the head unit 12. The printer 5 is therefore configured with a mechanism for unsticking the medium.

FIG. 7 illustrates rotation of the platen roller 11 in the forward direction (FR). More specifically, FIG. 7 shows when the platen roller 11 is rotating in the forward direction (FR), and after rotation in the forward direction (FR) stops. As described above, the head unit 12 is attached to a flat base 21. A spring 22 is disposed between the base 21 and the top frame 31 thereabove, and pushes the base 21 down. A support member 54 is formed along the side frame of the printer 5 at both left and right ends of the base 21. FIG. 7 shows the support member 54 formed on the right side of the base 21. A notch 54A is formed, at the back of the support member 54, and a pin 36 disposed to the side frame fits into this notch 54A. The pin 36 contacts the edge of the notch 54A, and supports the support member 54 from below. As a result, the support member 54 is pushed, by the urging force of the spring 22 from above, supported by the platen roller 11 and pin 36 from below, and is held in an appropriate position.

Because the notches 54A are larger than the pins 36, the side members 34 can move in the direction in which the pins 36 move inside the notches 54A. Because the pin 36 is against the back edge 54B of the notch 54A in the state shown in FIG. 7, the support member 54 cannot move further forward from this position, but the support member 54 can move to the back from the position shown in FIG. 7. When the platen roller 11 rotates in the forward direction (FR), force pulling the support member 54 forward with the head unit 12 works in conjunction with, movement of the continuous paper M. The head unit 12 can therefore be held in an appropriate position in the front-back direction by the pin 36 touching the back edge 54B and the platen roller 11 turning.

When the platen roller 11 turns in the reverse direction (RR), the head unit 12, base 21, and support member 54 move together to the back to the positions shown in FIG. 8.

In the state shown in FIG. 8, the pin 36 is at the front inside of the notch 54A, and the contact part 54C disposed to the back end of the support member 54 contacts a pin 37. This pin 37 protrudes from the side frame similarly to the pin 36, and is located behind the pin 36. Because the pin 37 limits movement of the support member 54 to the back, the support member 54 does not move further back from the position where the contact part 54C contacts the pin 37 as shown in FIG. 8. When the platen roller 11 turns in the reverse direction (RR), the force applied to the head unit 12, base 21, and support member 54 causes these to move to the back. The base 21 and support member 54 therefore move back due to this force until the contact part 54C contacts the pin 37, and thereafter remain in the position shown in FIG. 8.

The top of the notch 54A is an incline, and the pin 36 is held in constant contact with this incline by the urging force of the spring 22. The support member 54 is therefore pushed up by the pin 36 sliding against the incline when the support member 54 moves to the back. As a result, when the support member 54 is moved to the back, the support member 54 is pushed up by the pin 36 and slopes at an upward angle as shown in FIG. 8. Therefore, as a result of moving back and up with the support member 54, the head unit 12 moves to the side away from the platen roller 11. In addition, while the urging force of the spring 22 in the state shown in FIG. 7 is directed to the nipping point of the platen roller 11 and head unit 12, the spring 22 is tilted in the state shown in FIG. 8, and the force of the spring 22 is directed in a direction away from the platen roller 11. As a result, the force pushing the platen roller 11 and head unit 12 together weakens as a result of the head unit 12 moving to the back.

If the platen roller 11 turns in the reverse direction (RR) when the printing surface of the continuous paper M is stuck to the head unit 12 in the state shown in FIG. 7, the continuous paper M becomes unstuck from the head unit 12. More specifically, because the head unit 12 moves away from the platen roller 11 when the platen roller 11 turns in reverse, the pressure holding the continuous paper M against the head unit 12 weakens, and the continuous paper M can be more easily separated from the head unit 12. The continuous paper M is also guided downward by the paper guide 26 due to the reverse (R) conveyance force. As a result, the continuous paper M separates from the head unit 12 when the continuous paper M is conveyed.

Embodiment 3

In the printer 1 according to the first embodiment and the printer 5 according to the second embodiment of the invention, the continuous paper M sticking to the head unit 12 can be easily resolved by rotating the platen roller 11 in the reverse direction (RR). In other words, when the platen roller 11 turns in the reverse direction (RR) to unstick the medium, the head unit 12 moves in the direction away from the platen roller 11, and the adhesive force weakens. Slipping therefore occurs more easily when conveying the continuous paper M in reverse (R) than when conveying the continuous paper M forward (F) because the adhesive force on the continuous paper M is lower. As a result, the amount that the continuous paper M is actually conveyed (moved) will therefore differ when the continuous paper M is conveyed forward (F) and when the continuous paper H is conveyed in reverse (R) even if the platen roller 11 turns the same amount. In other words, the conveyance distance of the continuous paper M differs according to the conveyance direction.

Printers 1 and 5 therefore accurately defect the difference that occurs when conveying the continuous paper M, and compensates for this difference in conveyance distance, that is, the deviation in conveyance.

This operation is described next as a third embodiment of the invention.

The operation of a printer described in this third embodiment is applicable to both printer 1 and printer 5 described above. The operation of the invention is described below with reference to FIG. 9 to FIG. 12 as it applies to printer 5, but the same effect can obviously be achieved by applying the same control method to printer 1. FIG. 9 is a function block diagram of the control system of the printer 5. The control system of the printer 1 (FIG. 1) can be configured identically to the control system of the printer 5 shown in FIG. 9, and can execute the same operation described below with reference to FIG. 10 to FIG. 12.

The printer 5 has a control unit 101 (a control means) that controls parts of the printer 5. The control unit 101 includes CPU, ROM, RAM, and other peripheral circuits not shown, and controls other parts to print on the continuous paper M, for example, by running a control program.

A sensor drive circuit 102, head driver 103, motor driver 104, external interface 110, and operating panel 111 are connected to the control unit 101.

The sensor drive circuit 102 is connected to a paper sensor 28 and black mark sensor 29, and acquires and outputs detection results from the paper sensor 28 and black mark sensor 29 to the control unit 101.

The blackmark sensor 29 is a reflective photodetector that detects black marks (BM) on the back (the opposite side as the printing surface) of the continuous paper M. The black mark sensor 29 is disposed to the continuous paper M conveyance path downstream from the paper sensor 28, for example. More specifically, the detection position of the black mark sensor 29 is downstream from the paper sensor 28 and between the head unit 12 and the detection position of the paper sensor 28, for example. Because the black mark sensor 29 detects black marks disposed along an edge of the width of the continuous paper M, the black mark sensor 29 is not limited to detecting such black marks, and if notches are formed in the edge of the continuous paper M, can detect these notches.

The head driver 103 is connected to the head unit 12, and supplies drive current, to the heat elements of the head unit 12 as controlled by the control unit 101 to produce heat.

The motor driver 104 is connected to the conveyance motor 32 and the cutter drive motor 45. The conveyance motor 32 and cutter drive motor 45 are pulse motors in this example. The motor driver 104 outputs drive current and drive pulses to the conveyance motor 32 and cutter drive motor 45 as controlled by the control unit 101. The motor driver 104 can also invert the voltage of the drive current output to the conveyance motor 32 and cutter drive motor 45 as controlled by the control unit 101. As a result, the conveyance motor 32 and cutter drive motor 45 rotate the specific rotational distance in the specified direction of rotation as controlled by the control unit 101. The conveyance motor 32, platen roller 11, and a gear train (not shown in the figure) connecting the platen roller 11 to the conveyance motor 32 together function as a conveyance means (a conveyance unit).

The external interface 110 includes connectors or a wireless communication unit that connect to devices external to the printer 5. The external interface 110 connects to the host computer 2, for example, receives print data and print commands from the host computer 2, and outputs to the control unit 101.

The operating panel 111 includes switches that the operator operates, and a display unit that displays the operating status of the printer 5. The display unit may include LED indicators or an LCD panel, for example. The operating panel 111 outputs operating signals indicating switch operations to the control unit 101, and displays information on the display unit as controlled by the control unit 101.

The control unit 101 determines if continuous paper M is present based on the output of the paper sensor 28 input from the sensor drive circuit 102. The control unit 101 also drives the conveyance motor 32 through the motor driver 104 to convey the continuous paper M. If the output of the paper sensor 28 changes during conveyance, the control unit 101 detects the leading end and the trailing end of the continuous paper M, and a seam in the continuous paper M, based on change in detector output.

When new continuous paper M is loaded in the printer 5, the control unit 101 detects the position of a seam in the continuous paper M. Referenced to the position of the detected seam, the control unit 101 then executes an operation positioning the leading end to the start printing position based on the preset length of a continuous paper M form.

Figure 10:
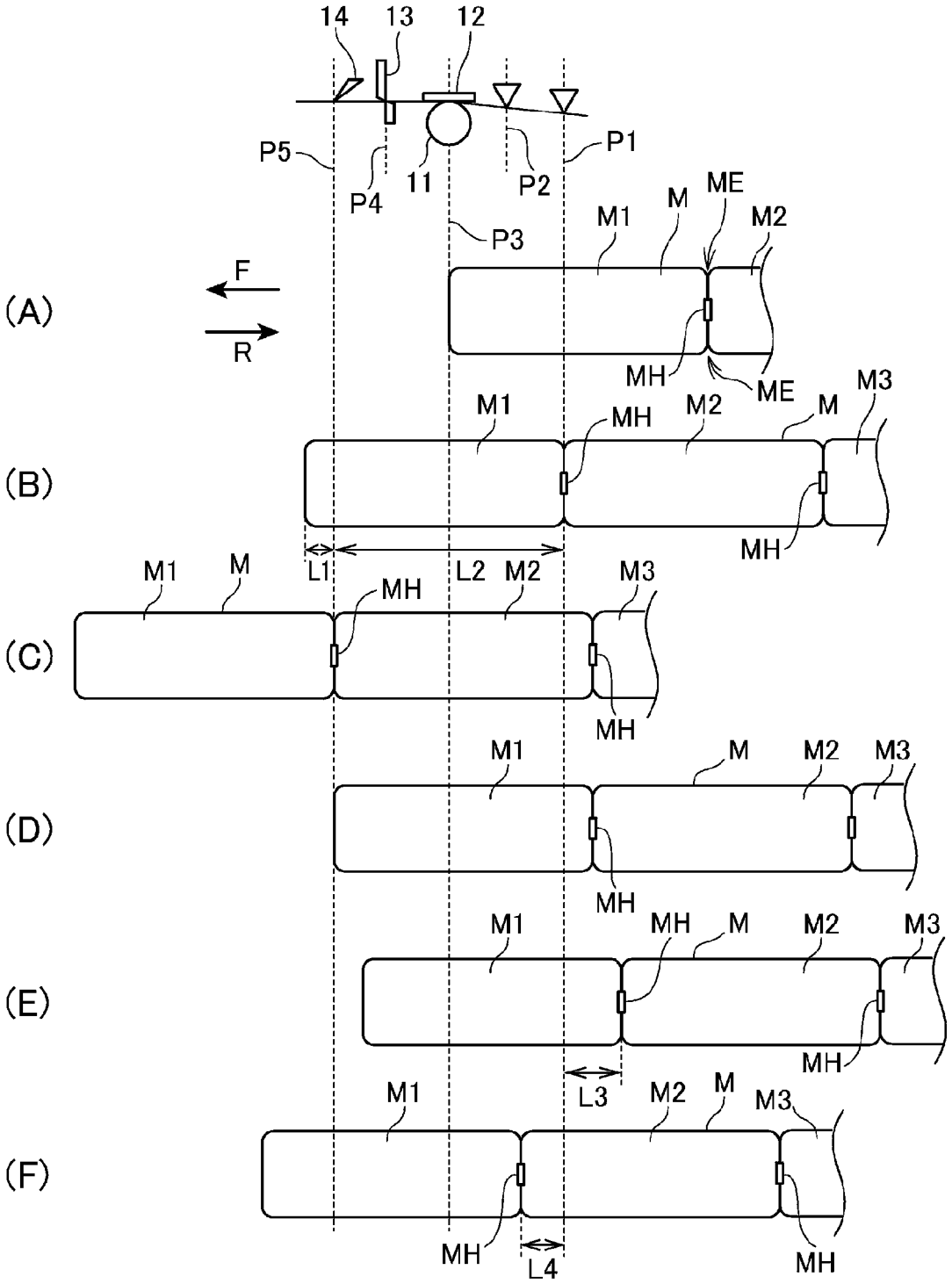
FIG. 10 schematically describes the relationship between parts of the printer and the position of the continuous paper.

FIG. 10 illustrates control related to detecting the position of and positioning the continuous paper M. Blocks (A) to (F) show the position of the continuous paper M on the conveyance path of the printer 5. The positions indicated by dotted lines P1 to P5 in (A) to (F) indicate specific positions on the conveyance path in the printer 5. Position P1 is the detection position of the paper sensor 28; position P2 is the detection position of the black mark sensor 29; and position P3 is the nipping position where the platen roller 11 and head unit 12 nip the continuous paper M. Position P4 is the cutting position of the automatic cutter 13; and position P5 is the cutting position of the manual cutter 14. The distances between these positions, and the length of the continuous paper M form, for example, are stored in ROM of the control unit 101.

The state immediately after continuous paper M is set in the printer 5 is shown in FIG. 10. The first form at the leading end of the continuous paper M is denoted M1, the second form is M2, and the third form is M3 in the figure. As described above, a perforation is formed at the joint (seam) between forms, and an elongated hole MH is formed on the perforation. This hole MH is a hole formed substantially in the widthwise center of the continuous paper M so that the border between forms of the continuous paper M can be optically or mechanically detected. The hole MH in this embodiment is long widthwise to the continuous paper M. A curved notch ME is also formed at both widthwise ends of the seam between adjacent forms of the continuous paper M. These notches ME are formed so that the corners of the forms separated from the continuous paper M are rounded, and the black mark sensor 29 can also detect the notches ME.

FIG. 10 (A) shows the state when the continuous paper M is loaded in the printer 5. To set the continuous paper H, the leading end of the continuous paper M is inserted from the back of the printer 5 through the paper guides 25, 26 until it meets the nipping position of the platen roller 11 and head unit 12 and stops. The leading end of the first form M1 at the leading end of the continuous paper M is thus at the nipping position of the platen roller 11, and the paper sensor 28 detects the form M1. While the control unit 101 detects the continuous paper M in the state shown in (A), where the continuous paper M is on the conveyance path is unknown.

The control unit 101 therefore drives the conveyance motor 32 to convey the continuous paper M forward (F), and stops the conveyance motor 32 when the paper sensor 28 detects a hole MH, that is, at the position shown in (B).

At the position shown in (B) in FIG. 10, the hole MH marking the seam between the first form M1 and the second form M2 is at detection position P1 of the paper sensor 28. The control unit 101 can first accurately determine the position of the continuous paper M on the conveyance path by conveying the continuous paper M to the position in (B).

The control unit 101 also conveys the continuous paper M forward (F) until the paper sensor 28 detects a hole MH, and stops when the paper sensor 28 detects the first hole MH as shown in (B), immediately after the printer 5 power turns on.

FIG. 10 (D) shows the start print position (standby position). At the start print position, the leading end of the continuous paper M is at position P5. When the first form M1 is printed and then cut by the manual cutter 14, the leading end of the next form M2 is at position P5. While waiting to print the next form after finishing printing one form of the continuous paper M, the leading end of the continuous paper M remains at position P5 as shown in (D).

To convey the continuous paper M from the position where the first hole MH in the continuous paper M is detected at (B) to the start position in (D), the control unit 101 executes one of two operations. These two operations are (1) setting the leading end of the first form M1 to position P5, and (2) setting the leading end of the second form M2 to position P5.

In operation (1), the continuous paper M is conveyed in reverse (R) length L1 shown in (B). As a result, the head unit 12 moves as described above, the nipping force holding the continuous paper M between the platen roller 11 and head, unit 12 decreases, the position of the continuous paper M can shift due to slipping, and the leading end cannot be easily set accurately to position P5.

In operation (2), the continuous paper M is conveyed, forward (F) length L2 shown in (B), and is positioned as shown in (C). In this event, there is no slipping because the direction of conveyance is only forward (F). However, the first form is conveyed to the downstream side of position P5 as shown in (C), is discarded without printing, and is thus wasted.

This embodiment of the invention executes operation (1) as controlled by the control unit 101. The control unit 101 can position the continuous paper M accurately by compensating for slipping that occurs when conveyed in reverse (R), that is, by compensating for the difference between the forward (F) and reverse (R) conveyance distances.

Figure 11:
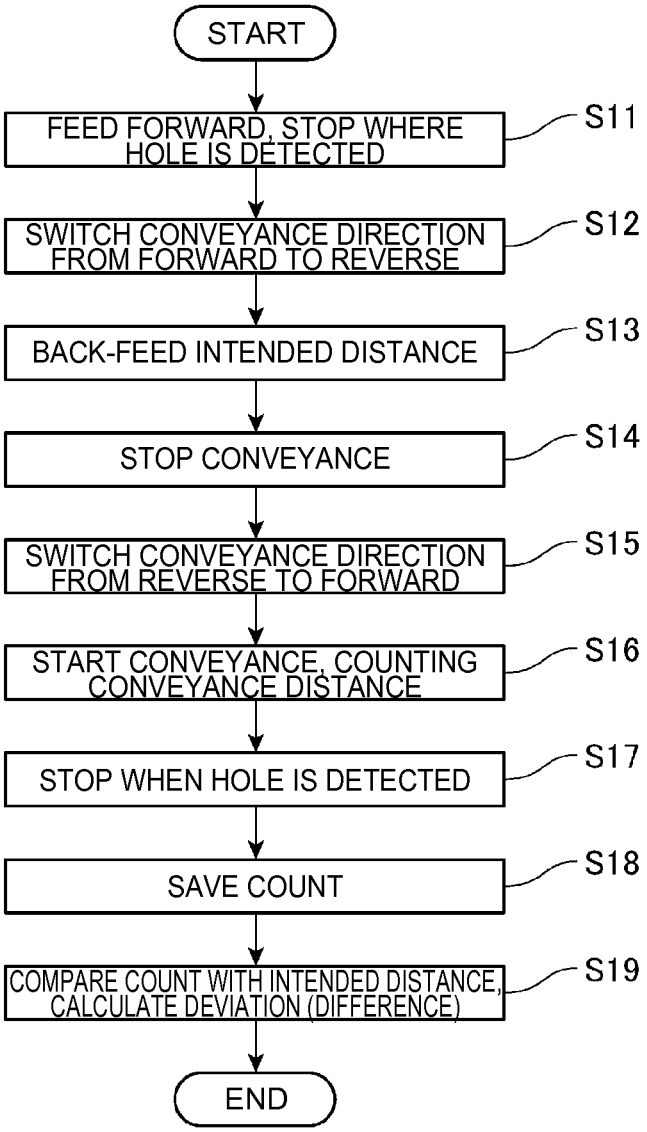
FIG. 11 is a flow chart illustrating operation of the printer.

FIG. 11 is a flow chart showing the operation of the printer 5, and particularly the deviation detection process that obtains the amount of shift due to control by the control unit 101.

Before the operation for detecting the amount of deviation, the control unit 101 conveys the continuous paper M forward (F) and stops when the paper sensor 28 detects the hole MH (step S11). The operation of step S11 is an initializing conveyance. This operation advances the continuous paper M to the position in (B).

The control unit 101 then switches the conveyance direction from forward (F) to reverse (R) (step S12). Switching the conveyance direction involves the motor driver 104 inverting the voltage output to the conveyance motor 32, and does not involve actually operating the conveyance motor 32. This switching operation is also referred to as a first switching operation.

The control unit 101 then conveys the continuous paper M in reverse (R) from the position in (B) a preset amount (step S13), and stops at the position in (E) (step S14). The operation of step S13 is also referred to as a first conveyance. The conveyance distance in this event is the length L3 shown in (E). The first form M1 could fall away from the nipping position of the platen roller 11 and head unit 12 if length L3 exceeds the length from position P1 to position P3, and length L3 is therefore set to this length or shorter. The number of steps the conveyance motor 32 operates to convey the continuous paper M length L3 is $\alpha$ in this embodiment.

The control unit 101 then switches the conveyance direction to the forward (F) (step S15), drives the platen roller 11 in the forward direction (FR) and advances the continuous paper M, and counts the media conveyance distance during conveyance (step S16). Switching the conveyance direction in step S15 is also referred teas a second switching operation, and the operation of step S16 is also referred to as a second conveyance. The control unit 101 then stops conveyance when a hole MK is detected by the paper sensor 28 (step S17). The continuous paper M has returned to the position in (B) when conveyance stops in step S17. The control unit 101 counts the number of steps the conveyance motor 32 turns during conveyance in steps S16 and S17 as the conveyance distance, and saves this count as β (step S18).

The control unit 101 then compares the step count (α) of the conveyance motor 32 during conveyance from (B) to (E) with the step count (β) of the conveyance motor 32 counted during conveyance from (E) to (B) (step S19).

The number of steps the conveyance motor 32 turns (operating distance of the conveyance means) is the theoretical conveyance distance, of conveyance controlled by the control unit 101, and is not the actual measured conveyance distance of the continuous paper M. However, because α and β are the values obtained referenced to the position (B) where the paper sensor 28 detected the hole MH, the difference between α and β reflects the difference between the intended (theoretical) conveyance distance and the conveyance distance that the continuous paper M actually travelled. The difference between α and β can therefore be handled as the difference in the conveyance distance when the continuous paper M is conveyed the same amount forward (F) and reverse (R). This difference in conveyance distances (deviation) is caused by the continuous paper M slipping during reverse (R) conveyance. The difference in the conveyance distances due to slipping during reverse (R) conveyance can therefore be obtained by calculating the difference between α and β. As a result, when conveying the continuous paper M in reverse (R), for example, the continuous paper M can be moved the actual intended amount by correction that adds a conveyance distance equal to the difference between reverse (R) conveyance and forward (F) conveyance to the intended reverse (R) conveyance distance (number of steps).

Deviation due to backlash can occur with the process shown in steps S12 to S19 in FIG. 11 because the conveyance direction changes. This "deviation" is the difference between how much the control unit 101 drives the conveyance motor 32 and the conveyance distance that the continuous paper M is actually conveyed. The conveyance direction changes twice, in steps S12 and S15, and this deviation due to backlash can occur immediately after conveyance starts in step S13 and immediately after conveyance starts in step S16. More specifically, the number of steps α the media is conveyed in step S13, and the number of conveyance steps β in steps S15 and S16, both contain the effect of backlash. By calculating the difference between α and β, the effect of backlash can be cancelled, and the difference in the conveyance distance due to factors other than backlash can be calculated.

In another example of the operation shown in FIG. 11, the difference in the conveyance distances can also be obtained when the continuous paper M is conveyed forward (F) from the position in (B) and is then conveyed in reverse (R).

In this operation, the control unit 101 first conveys the continuous paper M until the hole MH is positioned downstream from position P1, then reverses (R) the continuous paper M (initializing conveyance) to the position where the paper sensor 28 detects the hole MH, that is, the position in (B).

The control unit 101 then changes the conveyance direction from reverse (R) to forward (F) (first switching operation) and conveys the continuous paper M forward (F) to position (F) (first conveyance). The conveyance amount in this event is a predetermined length L4. Next, the control unit 101 changes the conveyance direction from forward (F) to reverse (R) (second switching operation), and conveys the continuous paper M until the hole MH is detected (second conveyance). The control unit 101 stops the continuous paper M at the point where the hole MH is stopped at position (B), and counts the conveyance distance (number of steps the conveyance motor 32 turns) until the continuous paper M stops at (B). Any deviation is then calculated based on the difference between the number of operating steps equal to the length L4 from (B) to (F), and the number of operating steps from (F) to (B). The effect is the same in this case because only the conveyance direction is reversed and the number of times the conveyance direction changes and the media is conveyed in the sequence does not change.

In another example of the operation shown in FIG. 11, the continuous paper M can be conveyed forward (F) (initializing conveyance) to the position in (B) before the sequence starts.

In this operation, the control unit 101 first conveys the continuous paper M forward (F) (initializing conveyance) from a position where the hole MH is upstream from position P1 until the paper sensor 28 detects the hole MH, that is, to position (B). The control unit 101 then conveys the continuous paper M forward (F) to position (F) (first conveyance). The conveyance amount in this event is a predetermined length L4. Next, the control unit 101 changes the conveyance direct Ion from forward (F) to reverse (R) (first switching operation), and conveys the continuous paper M a predetermined amount (second conveyance). The conveyance distance of this second conveyance is set, for example, to length L4+L3, and the control, unit 101 conveys the continuous paper M to position (E). The control unit 101 then changes the conveyance direction from reverse (R) to forward (F) (second switching operation), conveys the continuous paper M forward (F) until the hole MH is detected at posit ion (B), and then stops (third conveyance). In this event, the control unit 101 calculates the difference between the number of operating steps during forward (F) conveyance from (B) to (F) and from (E) to (B), and the number of operating steps from (F) to (E), and calculates the deviation based on this difference.

This sequence has one more conveyance operation from, the initializing conveyance to completion, but enables calculating deviation as in the above example. A configuration in which initializing conveyance of the continuous paper M to the position in (B) is forward (F), and the last conveyance before the sequence ends is forward (F), is also conceivable.

Figure 12:
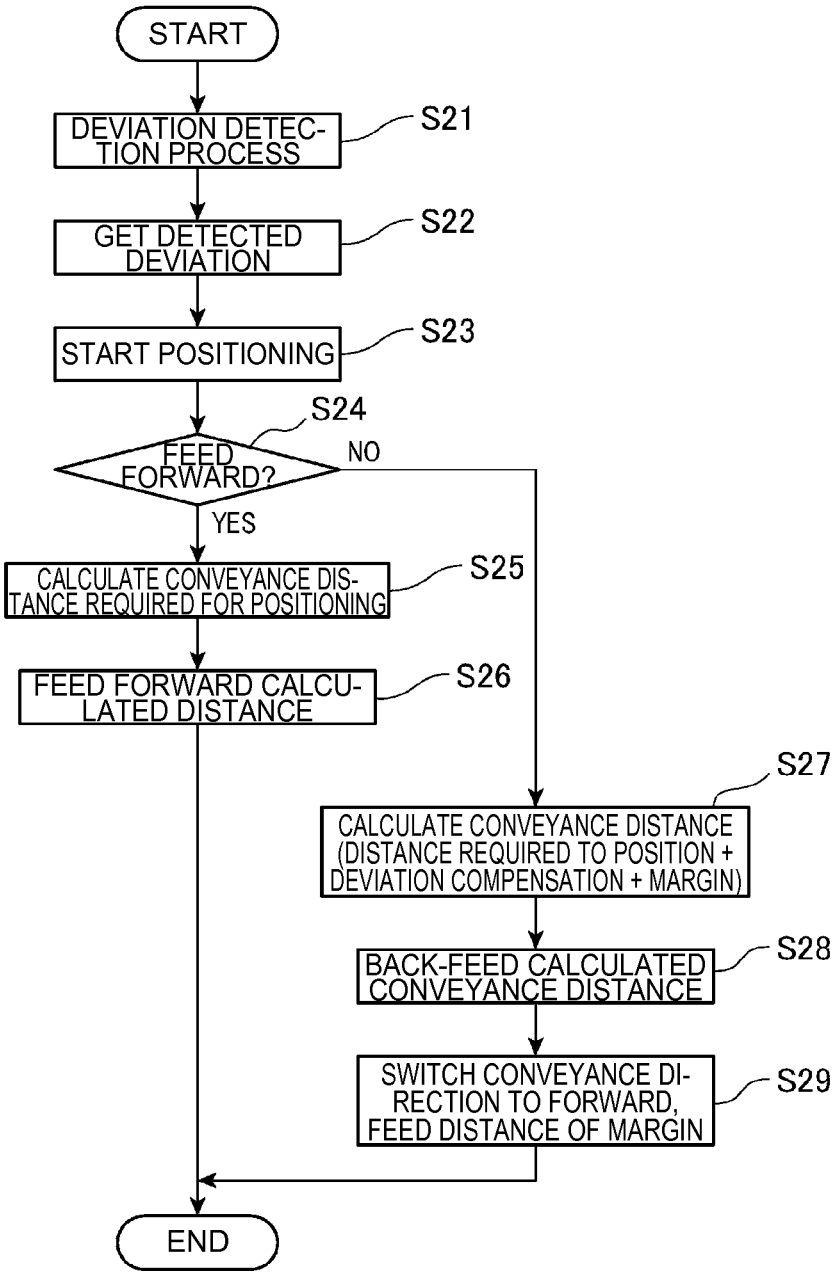
FIG. 12 is a flow chart illustrating operation of the printer.

FIG. 12 is a flow chart of the operation of the printer 5, and illustrates the operation of detecting deviation as shown in FIG. 11 and compensating for the detected deviation when positioning the media.

The control unit 101 first executes the deviation detection process described in FIG. 11 (step S21), and acquires the amount of deviation, that is, the difference in conveyance amounts (step S22).

The control unit 101 starts the process of positioning the leading end of the continuous paper M with position P5 (step S23). The control unit 101 first determines it the direction the continuous paper H must be conveyed for positioning from position (B) is forward (F) or not (step S24). For example, if the length of the form of the continuous paper M is less than the distance from position P1 to position P5, the medium is conveyed forward (F) to position the leading end of the form to position P5. Conversely, if the form length is greater than or equal to the distance from position P1 to position P5, the medium is conveyed in reverse (R) to set the leading end of the form to position P5.

If forward (F) conveyance is determined (step S24 returns YES), the control unit 101 calculates the conveyance distance required to set the leading end of the form to position P5 based on the form length and the distance from position P1 to position P5 (step S25). The control unit 101 then conveys the continuous paper M the calculated distance and stops (step S26), completing positioning.

Conversely, if reverse (R) conveyance is required (step S24 returns NO), the control unit 101 calculates the required conveyance distance (step S27). This conveyance distance includes the conveyance distance calculated from the form length and the distance from position P1 to position P5, the compensation amount for compensating for the amount of deviation obtained in step S22, and a marginal conveyance distance for conveying the medium to a position past position P5. The control unit 101 then conveys the continuous paper M in reverse (R) the amount calculated in step S27, and stops (step S28). At this point the leading end of the continuous paper M is upstream from position P5. The control unit 101 then reverses the conveyance direction from reverse (R) to forward (F), conveys the continuous paper M forward (F) the marginal, conveyance distance added in step S27, and completes positioning (step S29). The leading end of the continuous paper M thus overlaps position P5 as a result of steps S27 to S29. The conveyance mechanism including the conveyance motor 32 and platen roller 11 are in the state assumed when forward (F) conveyance stops. As a result, when the continuous paper M is next conveyed forward (F), such as when printing, there is no backlash.

As described above, the printer 5 in this aspect of the invention has a platen roller 11 and conveyance motor 32 as a conveyance means (a conveyance unit) capable of selectively conveying the continuous paper M in both forward (F) and reverse (R), and a control unit 101 that controls the conveyance motor 32 to convey the continuous paper M. The control unit 101 executes a conveyance sequence and obtains the difference in the conveyance distance of the continuous paper M when conveyed in both directions by operating the conveyance motor 32 the same amount. This sequence includes changing from forward (F) to reverse (R), and from reverse (R) to forward (F), the same number of times. This sequence also includes a first conveyance of the continuous paper M forward (F) or reverse (R), and a second conveyance in the opposite direction as the first conveyance. In the example shown in FIG. 11, the first conveyance is reverse (R) and the second conveyance is forward (F). By thus conveying the continuous paper M forward (F) and reverse (R), the difference in the distance conveyed in each conveyance direction as a result of slipping, for example, can be accurately and easily determined. Compensation for deviation due to backlash when the conveyance direction changes, for example, is also possible.

The printer 5 also has a paper sensor 28 that detects a hole MH that functions as a position recognition marker disposed to the continuous paper M. The control unit 101 starts the first conveyance from the position where the paper sensor 28 detects the hole MH, conveys the continuous paper M a specific amount in the first conveyance, and in the second conveyance conveys the continuous paper M until the paper sensor 28 detects the hole MH. The difference, in the conveyance distance forward (F) and reverse (R) can therefore be more accurately corrected referenced to the holes MH disposed in the continuous paper M.

The control unit 101 may also execute an initializing conveyance that conveys the continuous paper M before the sequence starts. As shown in step S11 in the example in FIG. 11, this initializing conveyance is in the opposite direction as the first conveyance, and is the same direction as the second conveyance.

More specifically, the control unit 101 executes a forward or reverse initializing conveyance, a first switching operation that changes the conveyance direction after the initializing conveyance, a first conveyance that conveys the continuous paper M after the first switching operation, a second switching operation that changes the conveyance direction after the first conveyance, and a second conveyance that conveys the continuous paper M after the second switching operation, and calculates the difference in the conveyance distances of the continuous paper M when the conveyance means is operated the same amount in both conveyance directions.

In this event, the second conveyance is forward (F) at the end of the sequence if the conveyance direction in the initializing conveyance is forward (F). As a result, the continuous paper H can be quickly conveyed forward (F) for printing, for example, without changing the conveyance direction after the sequence ends.

In another configuration, the control unit 101 executes an initializing conveyance, a first conveyance that conveys the continuous paper M in the same direction as the initializing conveyance, a first switching operation that changes the conveyance direction after the first conveyance, a second conveyance that conveys the continuous paper M after the first switching operation, a second switching operation that changes the conveyance direction after the second conveyance, and a third conveyance that conveys the continuous paper M after the second switching operation, and calculates the difference in the conveyance distances of the continuous paper M when, the conveyance means is operated the same amount in both conveyance directions.

Deviation can thus be efficiently calculated by determining the difference in the actual conveyance amount of the print medium when the conveyance means is operated the same amount in the first and third conveyances and the second conveyance. In this sequence the conveyance direction of the initializing conveyance is forward (F), the conveyance direction of the first conveyance is forward (F), and the third and last conveyance of the sequence is forward (F). As a result, the continuous paper M can be conveyed forward to the starting position of the first conveyance, the medium can be conveyed forward at the end of the sequence, and the sequence can then be ended. In this event, the continuous paper M can be quickly conveyed forward for printing, for example, without changing the conveyance direction after the sequence ends.

By thus configuring the sequence that determines deviation of the media according to the conveyance direction of the operation performed after the sequence ends, the operation after the sequence ends can be started quickly.

The control unit 101 also operates the conveyance motor 32 with consideration for the difference obtained by the sequence between the actual conveyance distance of the continuous paper M and the amount that the conveyance motor 32 was operated to convey the continuous paper M and position the leading end of the continuous paper M to the start print position. As a result, the continuous paper M can be accurately positioned. The continuous paper M can also be accurately positioned when the continuous paper M is conveyed in the opposite direction (R) as the conveyance direction when printing, and continuous paper M waste can be eliminated.

Furthermore, in the operation positioning the leading end of the continuous paper M to the start print position, the control unit 101 also sets the conveyance direction of the continuous paper H before stopping at the start print position to the same forward (F) direction as when printing on the continuous paper M as described in steps S27 to S29. There is, therefore, no need to change the conveyance direction when the continuous paper M is conveyed forward (F) for positioning because the continuous paper M is printed after positioning is completed. Printing can therefore start quickly and accurately because there is no deviation in position due to backlash when printing starts.

The printer 5 also has a head unit 12 that prints in contact with the continuous paper M, and a platen roller 11 that holds and conveys the continuous paper M together with the head unit 12. The head unit 12 can move to the side away from the platen roller 11 when conveying the continuous paper M in reverse (R). In this configuration, the continuous paper M can be pulled from the head unit 12 by movement of the head unit 12 during reverse (R) conveyance, and the continuous paper M can be unstuck if it has stuck to the printhead. The continuous paper M can slip easily in this configuration because the force holding the continuous paper M is released when conveying the continuous paper M in reverse (R), but deviation due to slipping depending on the conveyance direction can be accurately determined and appropriately corrected.

These benefits can also be achieved when printer 1 is operated as shown in FIG. 10 to FIG. 12.

The invention is described above with reference to preferred embodiments thereof, but is obviously not limited to the foregoing embodiments. For example, the third embodiment describes forming holes MH as position recognition markers indicating the border between and leading end of each form in the continuous paper M, but the position recognition markers could be shapes such as the holes MH or notches ME formed in the continuous paper M, or black marks or other colored markers. Affixed seals, for example, could also be used as the position recognition markers.

The continuous paper M may also be roll paper. If the continuous paper M is label paper having a liner and removable forms, for example, the position recognition markers may be on the peelable form or the liner.

The foregoing embodiments detect the holes MH formed as position recognition markers by an optical paper sensor 28, but could use the black mark sensor 29 instead. The presence of continuous paper M, and the positions of the holes MH or notches ME, could further alternatively be detected using a mechanical switch sensor that operates by fitting into a hole MH or notch ME.

The printer 5 is also not limited to a thermal printer that prints on thermal paper used as the continuous paper M, and the invention can obviously also be applied to inkjet printers, laser prints, dot impact printers, and other types of printers. Other aspects of the design and configuration of the printer 5, such as adding a buzzer, indicators, or display unit for reporting errors, can also be changed as desired without departing from the scope of the accompanying claims.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printing device comprising:

a conveyance unit that can change the conveyance direction and convey the print medium forward and reverse; and a control unit that controls the conveyance unit to convey the print medium, executes a sequence including switching from forward to reverse, switching the same number of times from reverse to forward, a first conveyance that conveys the print medium forward or reverse, and a second conveyance in the opposite direction as the first conveyance, and based on a conveyance amount of the first conveyance and a conveyance amount of the second conveyance, calculates the difference in the conveyance amounts of the print medium in both directions when the conveyance unit operates the same amount in each direction.

2. The printing device described in claim 1, further comprising:

a detection unit that detects a position recognition marker disposed to the print medium;

the control unit starting the first conveyance from the position where the detection unit detects the position recognition marker, conveying the print medium a specific amount in the first conveyance, and conveying the print medium in the second conveyance until the detection unit detects the position recognition marker.

3. The printing device described in claim 2, wherein:

the control unit executes an initializing conveyance forward or reverse, a first switching operation that changes the conveyance direction after the initializing conveyance, a first conveyance that conveys the print medium after the first switching operation, a second switching operation that changes the conveyance direction after the first conveyance, and a second conveyance that conveys the print medium after the second switching operation, and calculates the difference in the conveyance amounts of the print medium in both directions when the conveyance unit operates the same amount in each direction.

4. The printing device described in claim 2, wherein:

the control unit executes an initializing conveyance forward or reverse, a first conveyance that conveys the print medium in the same direction as the initializing conveyance, a first switching operation that changes the conveyance direction after the first conveyance, a second conveyance that conveys the print medium after the first switching operation, and a second switching operation that changes the conveyance direction after the second conveyance, a third conveyance that conveys the print medium after the second switching operation, and calculates the difference in the conveyance amounts of the print medium in both directions when the conveyance unit operates the same amount in each direction.

5. The printing device described in claim 1, wherein:

the control unit operates the conveyance unit only a preset amount in the first conveyance in the sequence, and in the second conveyance operates the conveyance unit until the print medium returns to the position before the first conveyance started, and based on the difference in the operation of the conveyance unit in the first and second conveyance operations, calculates the difference in the conveyance amounts of the print medium in each conveyance direction when the conveyance unit operates the same amount in each direction.

6. The printing device described in claim 5, wherein:

the control unit conveys the print medium by the conveyance unit and positions the leading end of the print medium to the start print position based on the difference in the operating amounts of the conveyance unit obtained by executing the sequence.

7. The printing device described in claim 6, wherein:

when positioning the leading end of the print medium to the start print position, the control unit sets the conveyance direction immediately before stopping the print medium at the start print position to the same direction as the conveyance direction when printing on the print medium.

8. The printing device described in claim 1, further comprising:

a printhead that prints in contact with the print medium; and a platen roller that holds and conveys the print medium together with the printhead;

the printhead being movable to the side separating from the platen roller when conveying the print medium in reverse.

9. The printing device described in claim 1, further comprising:

a printhead;

a platen roller in the conveyance unit; and a support mechanism that pushes the printhead toward the platen roller;

wherein the conveyance unit can change the direction of platen roller rotation forward and reverse; and the support mechanism supports the printhead to separate from the platen roller when the platen roller turns ill reverse.

10. A printhead comprising:

a support mechanism that includes a print unit that prints on a print medium, and a head unit opposite a platen roller that conveys the print medium, and supports and presses the head unit to the platen roller;

wherein the support mechanism has a support unit that supports a pivot point disposed substantially in the middle of the head unit, which extends in a direction intersecting the conveyance direction of the print medium, and supports the head unit movably in a direction that changes the position contacting the platen roller while supporting the head unit freely rockably on the pivot point and pressing the head unit to the platen roller, and the support mechanism moves the head unit as a result of the platen roller turning in the first direction, or turning in a second direction that is the opposite of the first direction.

11. The printhead described in claim 10, wherein:

the support unit has an incline that slopes in the direction away from the platen roller, and guides the pivot point along the incline.

12. A printing device comprising:

a conveyance unit having a platen roller that conveys a print medium, and changes driving the platen roller in forward and reverse;

a printhead opposite the platen roller;

a support mechanism that supports and presses a head unit of the printhead to the platen roller; and a control unit that controls the conveyance unit to convey the print medium;

wherein the support mechanism has a support unit that supports a pivot point disposed substantially in the middle of the head unit, which extends in a direction intersecting the conveyance direction of the print medium, and supports the head unit movably in a direction that changes the position contacting the platen roller while supporting the head unit freely rockably on the pivot point and pressing the head unit to the platen roller; and the control unit executes a sequence including switching from forward to reverse, switching the same number of times from reverse to forward, a first conveyance that conveys the print medium forward or reverse, and a second conveyance in the opposite direction as the first conveyance, and based on a conveyance amount of the first conveyance and a conveyance amount of the second conveyance, calculates the difference in the conveyance amounts of the print medium in both directions when the conveyance unit operates the same amount in each direction.

13. The printing device described in claim 12, wherein:

the support mechanism moves the head unit as a result of the platen roller turning in the first direction, or turning in a second direction that is the opposite of the first direction.

14. The printing device described in claim 12, wherein:

the support unit has an incline that slopes in the direction away from the platen roller, and guides the pivot point along the incline.

15. A positioning method of a printing device having a conveyance unit that can convey a print medium in forward and reverse directions, and a sensor that is disposed to the conveyance path of the print medium and detects a detection mark disposed on the print medium, the positioning method including:

switching the conveyance direction from forward to reverse;

switching the same number of times from reverse to forward;

a first conveyance that conveys the print medium forward or reverse;

a second conveyance in the opposite direction as the first conveyance;

calculating the difference in the conveyance amounts of the print medium in both directions when the conveyance unit operates the same amount in each direction based on a conveyance amount of the first conveyance and a conveyance amount of the second conveyance; and a leading end positioning operation that aligns the leading end of the print medium with a specific position based on a compensation amount that compensates for the calculated difference.

* * * * *